US006687191B2

(12) United States Patent
Watanabe et al.

(10) Patent No.: US 6,687,191 B2
(45) Date of Patent: Feb. 3, 2004

(54) CALENDAR TIMEPIECE

(75) Inventors: Mamoru Watanabe, Chiba (JP); Shigeo Suzuki, Chiba (JP); Kenichi Nakajima, Chiba (JP)

(73) Assignee: Seiko Instruments Inc., Chiba (JP)

( * ) Notice: Subject to any disclaimer, the term of this patent is extended or adjusted under 35 U.S.C. 154(b) by 243 days.

(21) Appl. No.: 09/814,519

(22) Filed: Mar. 22, 2001

(65) Prior Publication Data

US 2001/0028604 A1 Oct. 11, 2001

(30) Foreign Application Priority Data

Mar. 31, 2000 (JP) ..... 2000-096222

(51) Int. Cl.[7] ..... G04B 19/24
(52) U.S. Cl. ..... 368/37; 368/28
(58) Field of Search ..... 368/28, 34, 35, 368/36, 37, 38

(56) References Cited

U.S. PATENT DOCUMENTS

| | | | | |
|---|---|---|---|---|
| 3,911,667 A | * | 10/1975 | Komiyama | 368/35 |
| 4,050,233 A | * | 9/1977 | Ingenieur | 368/35 |
| 4,204,395 A | * | 5/1980 | Ikenishi et al. | 368/35 |
| 4,496,246 A | * | 1/1985 | Ota et al. | 368/88 |
| 5,903,519 A | * | 5/1999 | Takahashi et al. | 368/35 |
| 5,956,294 A | * | 9/1999 | Takizawa et al. | 368/35 |

FOREIGN PATENT DOCUMENTS

| | | |
|---|---|---|
| CH | 853171 | 1/1973 |
| FR | 2355321 | 1/1978 |

OTHER PUBLICATIONS

Patent Abstracts of Japan, vol.008, No.183 (P–296) Aug. 23, 1984, EPO publication No. 59073789 dated Apr. 26, 1984.

* cited by examiner

*Primary Examiner*—David Martin
*Assistant Examiner*—Jeanne-Marguerite Goodwin
(74) *Attorney, Agent, or Firm*—Adams & Wilks

(57) ABSTRACT

A calendar timepiece has a main plate having a guide portion and a date indicator driving wheel mounted on the main plate to undergo rotation. A date feed finger is connected to the date indicator driving wheel for rotation therewith to engage the guide portion of the main plate so that the date feed finger is displaced in a generally thickness direction of the main plate. A date indicator has a tooth portion for meshing engagement with the date feed finger when the date feed finger engages the guide portion of the main plate and is displaced in the thickness direction of the main plate so that the date indicator undergoes rotation relative to the main plate to indicate date information during rotation of the date feed finger. A day feed finger is connected to the date indicator driving wheel for rotation therewith. A day indicator is connected to the day feed finger for rotation therewith to indicate a day of the week.

27 Claims, 20 Drawing Sheets

CALENDAR TIMEPIECE

BACKGROUND OF THE INVENTION

1. Field of the Invention:

The present invention relates to a timepiece having a calendar mechanism and, more particularly, to a timepiece having a small, thin calendar mechanism that prevents erroneous operation of a day indicator.

2. Description of the Prior Art:

Referring to FIG. 19 and FIG. 20, the conventional timepiece with calendar mechanism, e.g. a movement (mechanical body) 400 of an analog electronic timepiece, has a main plate 402 structuring a base plate of the movement 400. A dial 404 (shown by the virtual line in FIG. 20) is attached on the movement 400.

In the analog electronic timepiece, of the opposite sides of the main plate 402, the side the dial 404 exists is referred to as a "back side" of the movement 400 and the side opposite to the side having the dial 404 is referred to as a "front side" of the movement 400. The train wheel assembled on the "front side" of the movement 400 is referred to as a "front train wheel" and the train wheel assembled on the "back side" of the movement 400 is referred to as a "back train wheel".

On the "front side" of the movement 400 are arranged a battery, a circuit block, a step motor, a front train wheel, a switch device (all not shown). By the rotation of the step motor, the front train wheel is rotated.

A center pipe 402*a* is provided on the main plate 402. An hour wheel 410 is provided rotatable relative to the center pipe 402*a*, and rotates twice per day due to rotation of the front train wheel. A date indicator driving wheel 412 is provided to rotate once per day due to rotation of the hour wheel 410.

A date indicator 420 is provided rotatable relative to the main plate in order to indicate date. The date indicator 420 has a date-indicator teeth portion 422 having 31 teeth and a date plate 424 printed with characters to indicate date. A day indicator 430 is provided rotatable relative to the main plate to indicate day of the week. The day indicator 430 has a day star wheel 432 having 7 or 14 or 21 teeth and a day plate printed with characters to indicate day of the week.

The date indicator driving wheel 412 is provided with a date feed finger 414 capable of rotating the date indicator 420 by one day per day and a day feed finger 416 capable of rotating the day indicator 430 by one day per day.

The date feed finger 414 is structured integral with the date indicator driving wheel 412 through a date feed finger spring portion 414*b*. The day feed finger 416 is structured integral with the date indicator driving wheel 412 through a day feed finger spring portion 416*b*.

The date feed finger 414 is structured to rotate not to enter a rotation path of the day star wheel 432.

However, in the conventional timepiece with calendar mechanism, unless the date feed finger is arranged not to enter a rotation path of the day star wheel, the date feed finger will mesh with the day star wheel resulting in a fear of erroneously operation of the day indicator.

Furthermore, in order to reduce the planar size of the timepiece with calendar mechanism while avoiding erroneous operation of the day indicator, there is a need to secure sufficiently great a gap in a thickness direction between the date feed finger and the day star wheel, which tends to increase the thickness of the timepiece.

SUMMARY OF THE INVENTION

Therefore, in order to solve the foregoing drawbacks in the conventional art, it is an object of the present invention to realize a small-and-thin type timepiece with a calendar mechanism that prevents erroneous operation of the day indicator.

Another object of the invention is to realize a timepiece with a calendar mechanism provided with such a date feed mechanism that the date feed finger can positively rotate the date indicator.

In order to solve the above problem, the present invention is, in a timepiece with calendar having a main plate structuring a base plate of a movement, a date indicator rotatably provided relative to the main plate to indicate date and having a date indicator teeth portion, a day indicator rotatably provided relative to the main plate to indicate day of the week and having a day star wheel, and a date indicator driving wheel rotating once per day to enable the date indicator to rotate by an amount of one day per day and the day indicator to rotate by an amount of one day per day, characterized in that: the date indicator driving wheel having a date feed finger capable of rotating the date indicator by an amount of one day per day and a day feed finger capable of rotating the day indicator by an amount of one day per day; the date feed finger being structured integral with the date indicator driving wheel through a date feed finger spring portion; the day feed finger being structured integral with the date indicator driving wheel through a day feed finger spring portion; the date feed finger being structured to rotate passing on main plate side of the day star wheel of the day indicator; wherein provided is a date feed finger guide portion to secure meshing in a thickness direction between the date feed finger and the date indicator teeth portion when the date feed finger meshes with the date indicator teeth portion.

Also, in the timepiece with calendar mechanism, the date feed finger guide portion is preferably provided on a back side of the main plate.

Also, in the timepiece with calendar mechanism, a slant surface is preferably provided in a portion that the date indicator driving wheel rotates and the date feed finger first contacts the date feed finger guide portion.

Also, in the timepiece with calendar mechanism, a semi-spherical convex portion is preferably provided in a portion that the date feed finger contacts the date feed finger guide portion.

Also, in the timepiece with calendar mechanism, the day feed finger is preferably structured to pass through on a dial side of the date indicator teeth portion, and the day feed finger being structured to rotate contacting the date feed finger guide portion in order to secure a gap in a thickness direction between the day feed finger and the date indicator teeth portion when the day feed finger rotates through the dial side of the date indicator teeth portion.

By the foregoing construction, in the timepiece with calendar mechanism, there is no fear of erroneous operation of the day indicator so that the date feed finger can positively rotate the date indicator. Further, by the foregoing construction it is possible to realize a small, thin timepiece with a calendar mechanism.

Also, in the timepiece with calendar mechanism, preferably provided in place of providing the date feed guide portion are a date feed finger guide groove portion to secure a mesh amount in a thickness direction between the date feed finger and a feed operating tooth portion when the date feed finger meshes with the feed operating tooth portion to be fed, an inner guide portion to prevent a decrease of the mesh amount between the date feed finger and the feed operating tooth portion and an outer guide portion to prevent an increase of the mesh amount between the date feed finger and the feed operating tooth portion.

By providing an inner guide portion, it is possible to effectively prevent a mesh amount between the date feed finger and the operating tooth portion from decreasing more than required. Also, by providing an outer guide portion, it is possible to effectively prevent a mesh amount between the date feed finger and the operating tooth portion from increasing more than required. Accordingly, by thus structuring, the date feed finger can positively rotate the date indicator.

Also, in the timepiece with calendar mechanism, preferably provided is a date feed forward gap secure portion to secure a gap in a planar direction between the date feed finger and a feed waiting tooth portion when the date feed finger rotates through a point near the feed waiting tooth portion to be next fed.

By the foregoing construction, it is possible to eliminate the fear that prior to date the date feed finger erroneously operates the date indicator.

Furthermore, in the timepiece with calendar mechanism, preferably provided is a date feed rear gap secure portion to secure a gap in a planar direction between the date feed finger and a feed end tooth portion when the date feed finger rotates through a point near the feed end tooth portion having been fed.

By the foregoing construction, it is possible to eliminate the fear that after date the date feed finger erroneously operates the date indicator.

Also, in the invention, preferably the timepiece with calendar mechanism is structured as an analog electronic timepiece, the timepiece with calendar mechanism having a quartz oscillator structuring source oscillation and a step motor to rotate the front train wheel, the step motor being structured to include a coil block, a stator and a rotor, and one part of the quartz oscillator and one part of the coil block being arranged to overlap with the date indicator.

By the foregoing construction, in the timepiece with calendar mechanism, because one part of the quartz oscillator, one part of the coil block and date indicator can be arranged compactly, a small, thin timepiece with a calendar mechanism can be realized.

BRIEF DESCRIPTION OF THE DRAWINGS

A preferred form of the present invention is illustrated in the accompanying drawings in which.

DETAILED DESCRIPTION OF THE PREFERRED EMBODIMENTS

Figure 1:
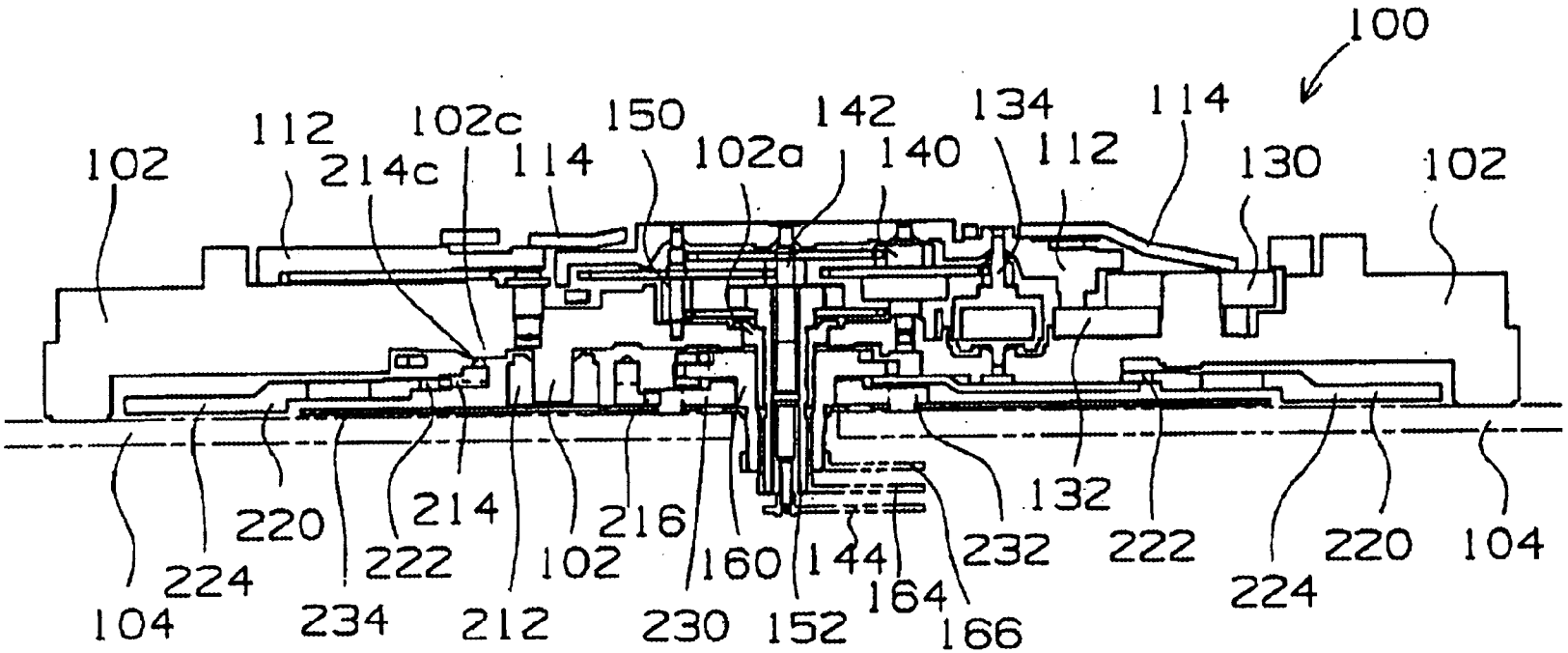
FIG. 1. is a fragmentary sectional view showing an embodiment of a timepiece with calendar mechanism of the present invention.
Figure 2:
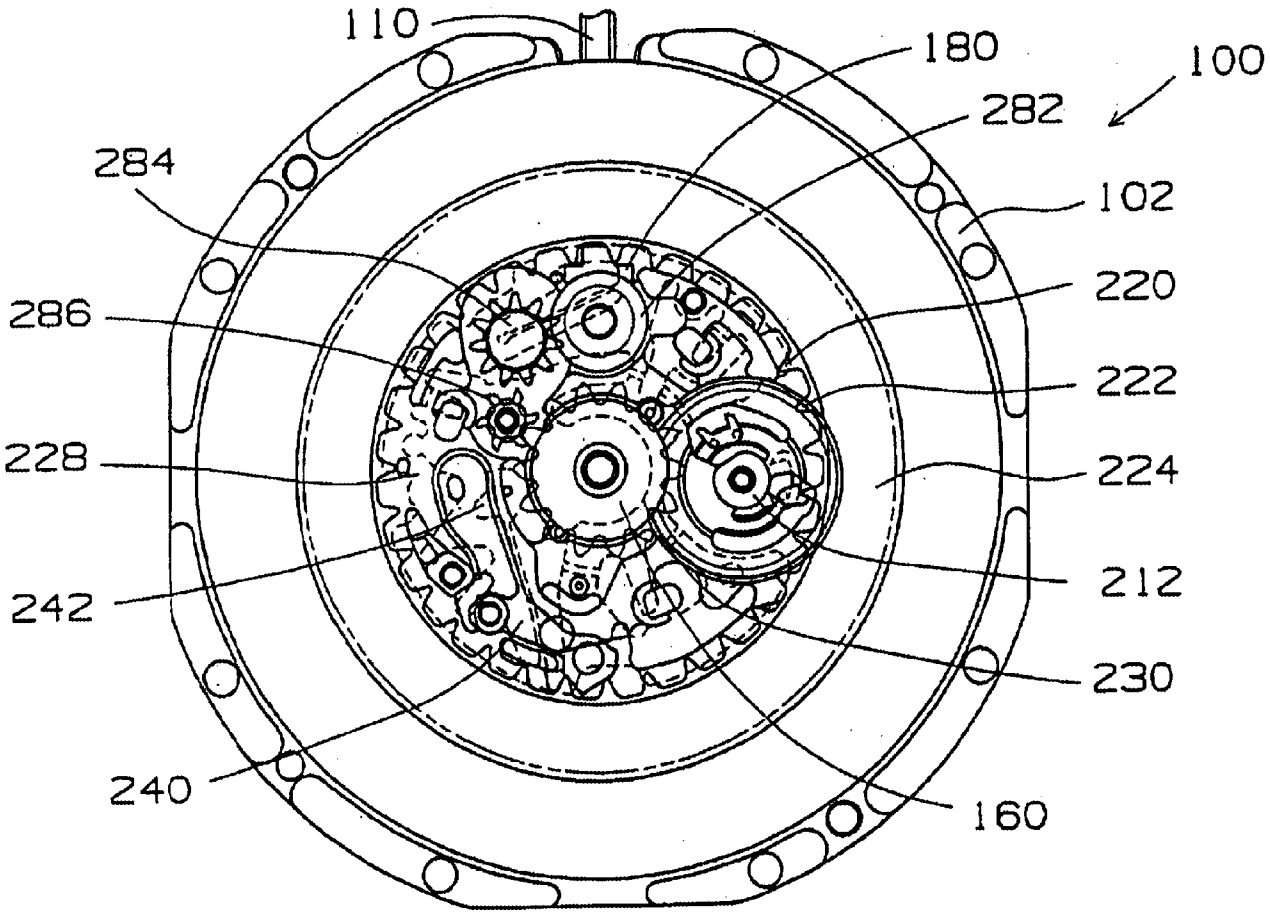
FIG. 2. is a schematic plan view as viewed from a side having a calendar mechanism in the embodiment of the timepiece with calendar mechanism of the invention (showing a state that a date indicator holder and day plate is removed)
Figure 3:
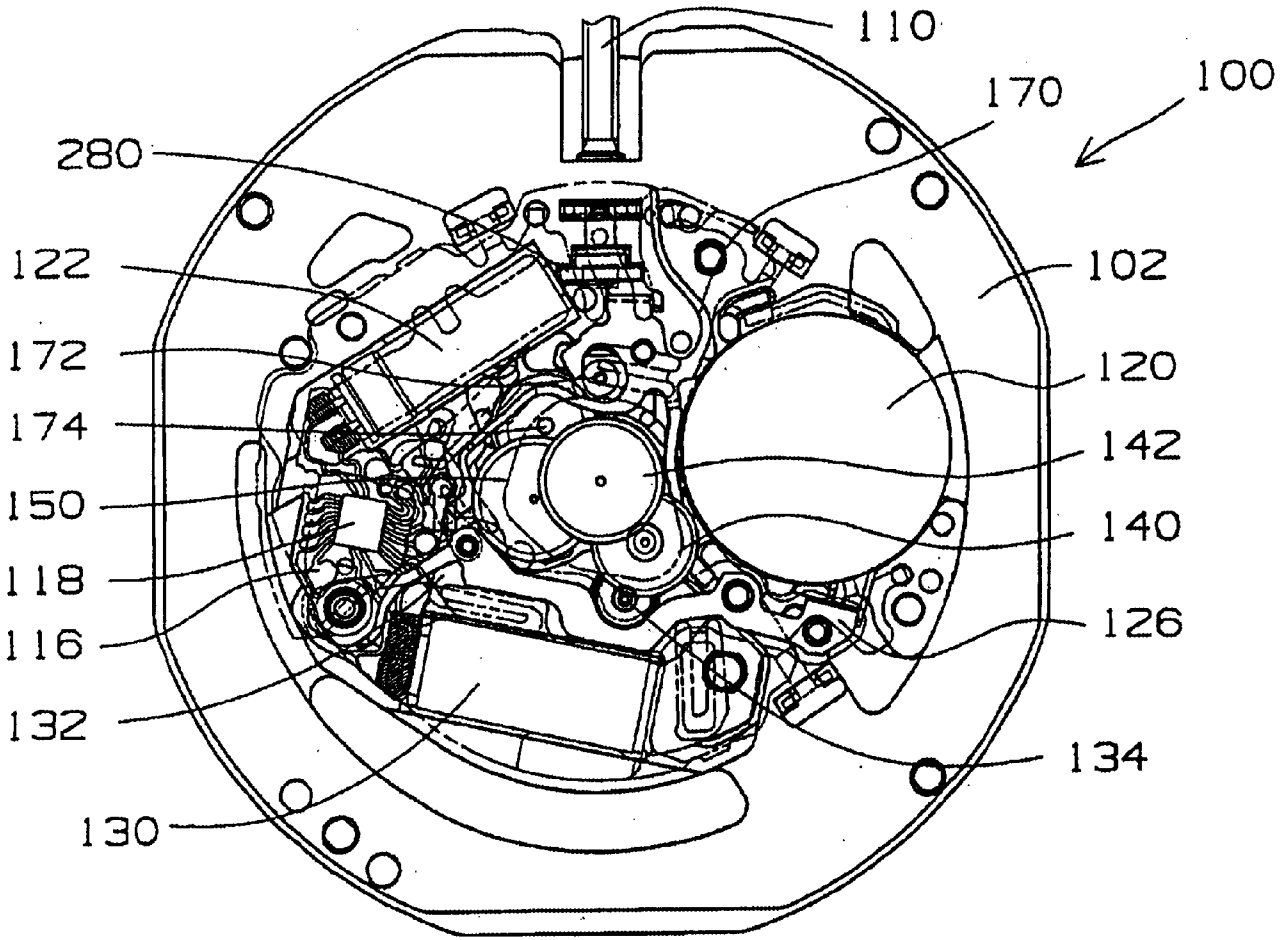
FIG. 3 is a schematic plan view as viewed from a side having a front train wheel (side opposite to the side the calendar mechanism exists) in the embodiment of the timepiece with calendar mechanism of the invention (showing a state that a train wheel bridge, insulation plate and holder plate is removed)

Hereunder, an embodiment of a timepiece with calendar mechanism of the present invention will be explained based on the drawings.

Although the explanation below is on a structure in which the timepiece with calendar mechanism of the invention is applied to an analog electronic timepiece, the invention is to be applied also to a mechanical timepiece besides the analog electronic timepiece. That is, the concept of "timepiece with calendar mechanism" in the present specification is a concept including "analog electronic timepieces", "mechanical timepieces" and analog timepieces on all other operation principles.

Referring to FIGS. 1–4, a movement (mechanical body) 100 of the timepiece with calendar mechanism of the invention has a main plate 102 defining a base plate for the movement 100. A dial 104 (shown by the virtual line in FIG. 1) is mounted on the movement 100.

On a "front side" of the movement 100 are arranged a battery 120, a circuit block 116, a step motor, a front wheel train, a change-over device (not shown) and so on. The front wheel train rotates due to rotation of the step motor. An IC 118 and a quartz oscillator 122 are attached on the circuit block 116. The battery 120 constitutes a power source for the timepiece with calendar mechanism. The quartz oscillator 122 constitutes source oscillation for the timepiece with calendar mechanism and oscillates, for example, at 372 or 768 Hertz.

The front wheel train is rotatably supported by the main plate 102 and wheel train bridge 112. A circuit holding plate 114 is provided in a manner holding the circuit block 116 to the train wheel bridge 112. A battery minus terminal 126 is held to the wheel train bridge 112. An insulation plate 128 is arranged between the battery minus terminal 126 and the holding plate 114.

The IC 118 includes an oscillator section, a frequency-divider section and a driver section. The oscillator section outputs a reference signal based on oscillation by the quartz oscillator 122. The frequency-divider section divides an output signal of the oscillator section. The driver section outputs a motor drive signal to drive the step motor based on the output signal of the frequency-divider section.

The step motor includes a coil block 130, a stator 132 and a rotor 134. When the coil block 130 inputs a motor drive signal, the stator 132 is magnetized to rotate the rotor 134. The rotor 134 is structured, for example, to rotate 180 degrees per second.

Based on rotation of the rotor 134, a fourth wheel and pinion 142 is structurally rotates through rotation of the fifth wheel and pinion 140. The fourth wheel and pinion 142 is structured to rotate once per minute. A second hand 144 is attached on the fourth wheel and pinion 142. The fourth wheel and pinion 142 may be arranged at a center of the timepiece or in a position other than the timepiece center.

A wheel train setting lever 170 is provided to be allowed to rotationally operated when drawing out a hand setting stem 110 to a second stage and regulates the position of the fourth wheel and pinion 142.

A third wheel and pinion 150 is structured to rotate based on rotation of the fourth wheel and pinion 142. A second wheel and pinion 152 is structured to rotate based on rotation of the third wheel and pinion 150. A minute wheel may be used in place of the center wheel and pinion 152. A minute hand 164 is attached on the second wheel and pinion 152. A slip mechanism is provided on the center wheel and pinion 152. When adjusting the hands by the slip mechanism, the minute hand 154 and an hour hand can be rotated by rotating the hand setting stem 110 while the second hand 144 is stopped. The second wheel and pinion 152 is structured to rotate once per hour.

A minute wheel 174 is structured to rotate based on rotation of the second wheel and pinion 152. A setting wheel 172 is provided which rotates through rotation of a clutch wheel (not shown) when the hand setting stem 110 is drawn to the second stage. When the hand setting stem 110 is drawn to the second stage, structure is made to rotate through rotation of the minute wheel 174 and clutch wheel (not shown).

A center pipe 102*a* is provided on the main plate 102. An hour wheel 160 is rotatably provided on the center pipe 102*a*. The hour wheel 160 is structured to rotate once per 12 hours. An hour hand 166 is attached on the hour wheel 160.

By rotating a date indicator driving pinion (not shown) of the hour wheel 160, a date indicator driving wheel 212 is structurally rotated. The date indicator driving wheel 212 is provided to rotate once per day due to rotation of the hour wheel 160.

A date indicator 220 is provided rotatable relative to the main plate 102 in order to indicate date. The date indicator 220 has a date indicator teeth portion 222 having 31 teeth and a date plate 224 printed with characters to indicate date. A date indicator holder 228 rotatably holds the date indicator 220 relative to the main plate 102.

A day indicator 230 is rotatably provided relative to the main plate 102 in order to indicate day of the week. The day indicator 230 has a day star wheel 232 having 14 teeth and a day plate 234 printed with characters to indicate day of the week.

The rotation of the date indicator 220 is regulated by a date jumper 240. The rotation of the day indicator 230 is regulated by a day jumper 242. The day jumper 242 is integrally formed with the date indicator holder 228.

A first calendar correction wheel 280 is provided to rotate through rotation of the clutch wheel (not shown) when the hand setting stem 110 is with drawn to a first stage. A second calendar correction wheel 282 is provided to rotate through rotation of the clutch wheel and first calendar correction wheel 280 when the hand setting stem 110 is withdrawn to the first stage. A calendar correction wheel 284 is provided to rotate through rotation of the clutch wheel, first calendar correction wheel 280 and second calendar correction wheel 282 when the hand setting stem 110 is withdrawn to the first stage. The calendar correction wheel 284 is structured to swing only a constant angle about a rotation center of the second calendar correction wheel 282. A day correction transmission wheel 286 is arranged to rotate the day star wheel 232 by the rotation thereof.

When the hand setting stem 110 is withdrawn to the first stage, if the hand setting stem 110 is rotated in a first direction, the calendar correction wheel 284 structurally swings in the first direction and rotates at a constant position to enable the date indicator 220 to rotate. When the hand setting stem 110 is withdrawn to the first stage, if the hand setting stem 110 is rotated in a second direction (direction opposite to the first direction), the calendar correction wheel 284 is structurally swings in the second direction (direction opposite to the first direction) and rotates at a constant position to enable the day correction transmitting wheel 286 to rotate. By rotating the day correction transmitting wheel 286, the day star wheel 232 can be structurally rotated.

Figure 4:
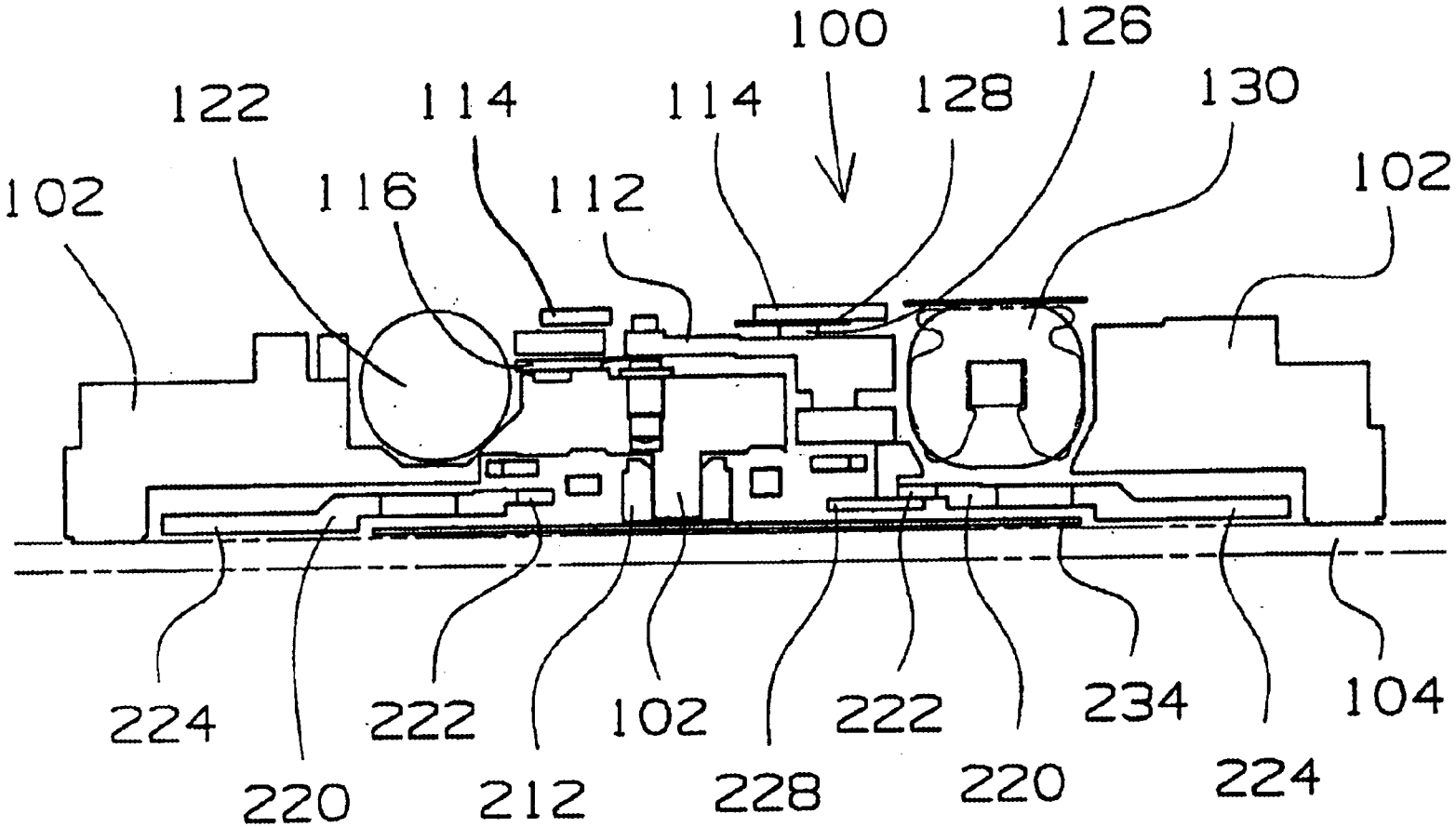
FIG. 4. is a fragmentary sectional view showing a quartz unit, date indicator driving wheel and coil block in the embodiment of the timepiece with calendar mechanism of the invention.

Referring to FIG. 4, a part of a quartz oscillator 122 and a part of the coil block 130 arranged on the "front side" are arranged in a manner overlapping the date indicator 220 arranged on a "back side" of the movement 100.

Figure 5:
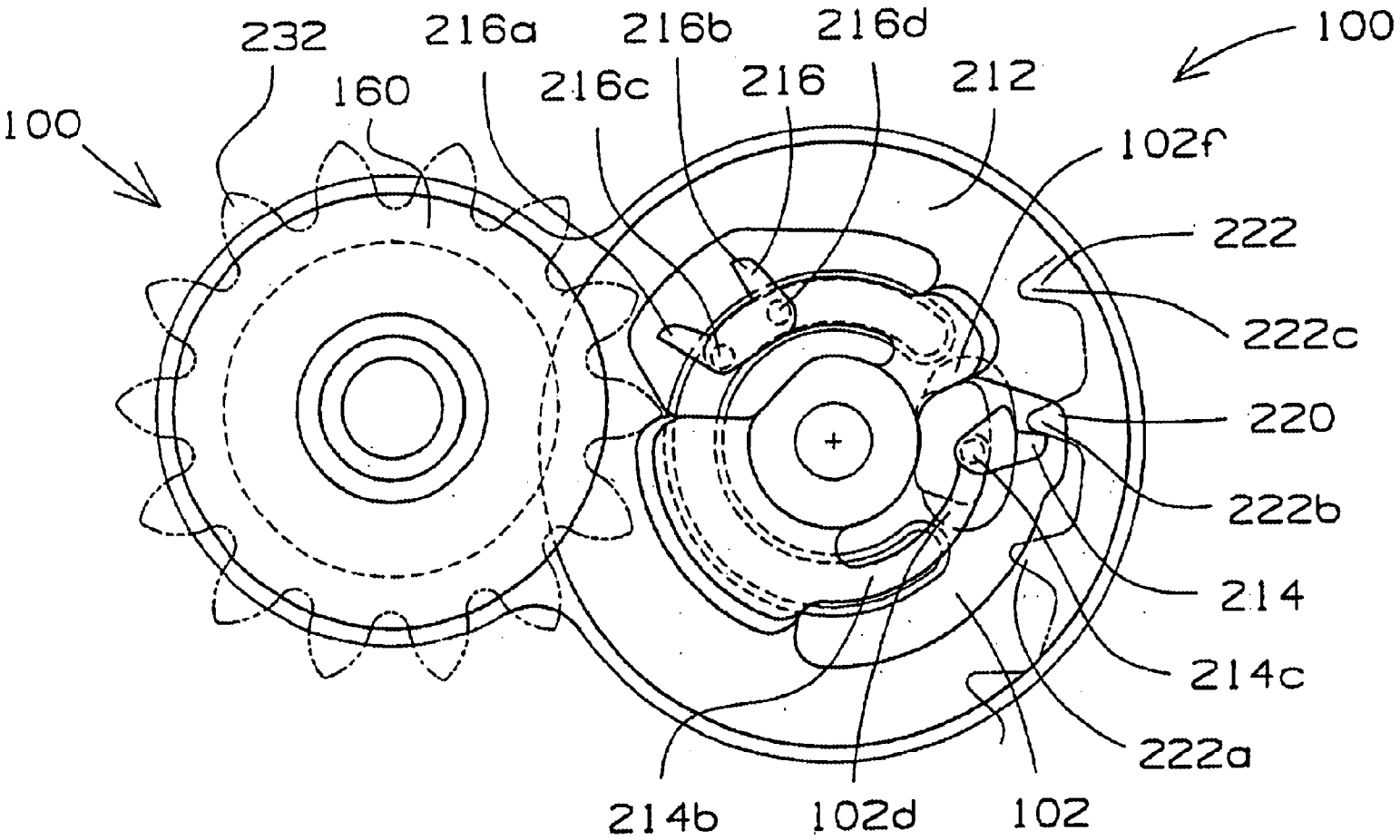
FIG. 5. is a magnified fragmentary plan view showing a date indicator, date indicator driving wheel and day star wheel in a date feed state in the embodiment of the timepiece with calendar mechanism of the invention.
Figure 6:
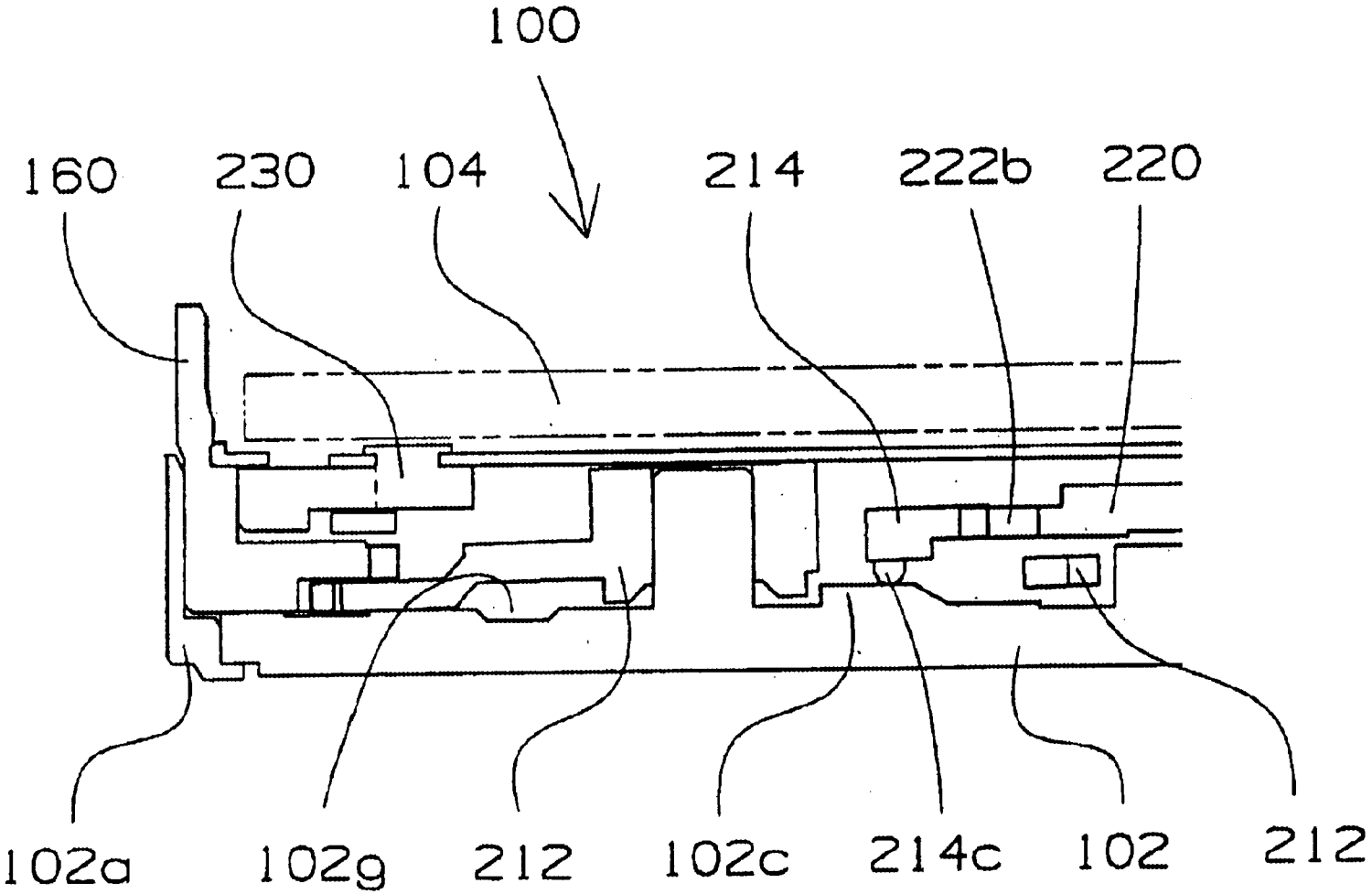
FIG. 6. is a magnified fragmentary sectional view showing the date feed state of FIG. 5 in the embodiment of the timepiece with calendar mechanism of the invention.

Referring to FIG. 5 and FIG. 6, date indicator teeth 222 includes a feed operation tooth portion 222*b* now to be fed, a feed-waiting tooth portion 222*a* next to be fed, and a fed tooth portion 222*c* having already fed. A date indicator driving wheel 212 has a date feed finger 214 capable of rotating the date indicator 220 by an amount of one day per day and a day feed finger 216 capable of rotating the day indicator 230 by an amount of one day per day.

The date feed finger 214 is structured to be integral with the date indicator driving wheel 212 through a date feed finger spring portion 214*b*. The day feed finger 216 is structured to be integral with the date indicator driving wheel 212 through a day feed finger spring portion 216*e*.

A semispherical date feed finger convex portion is provided on the back side (main plate side) of the intersection of the date feed finger 214 and the date feed finger spring portion 214*b*.

Figure 13:
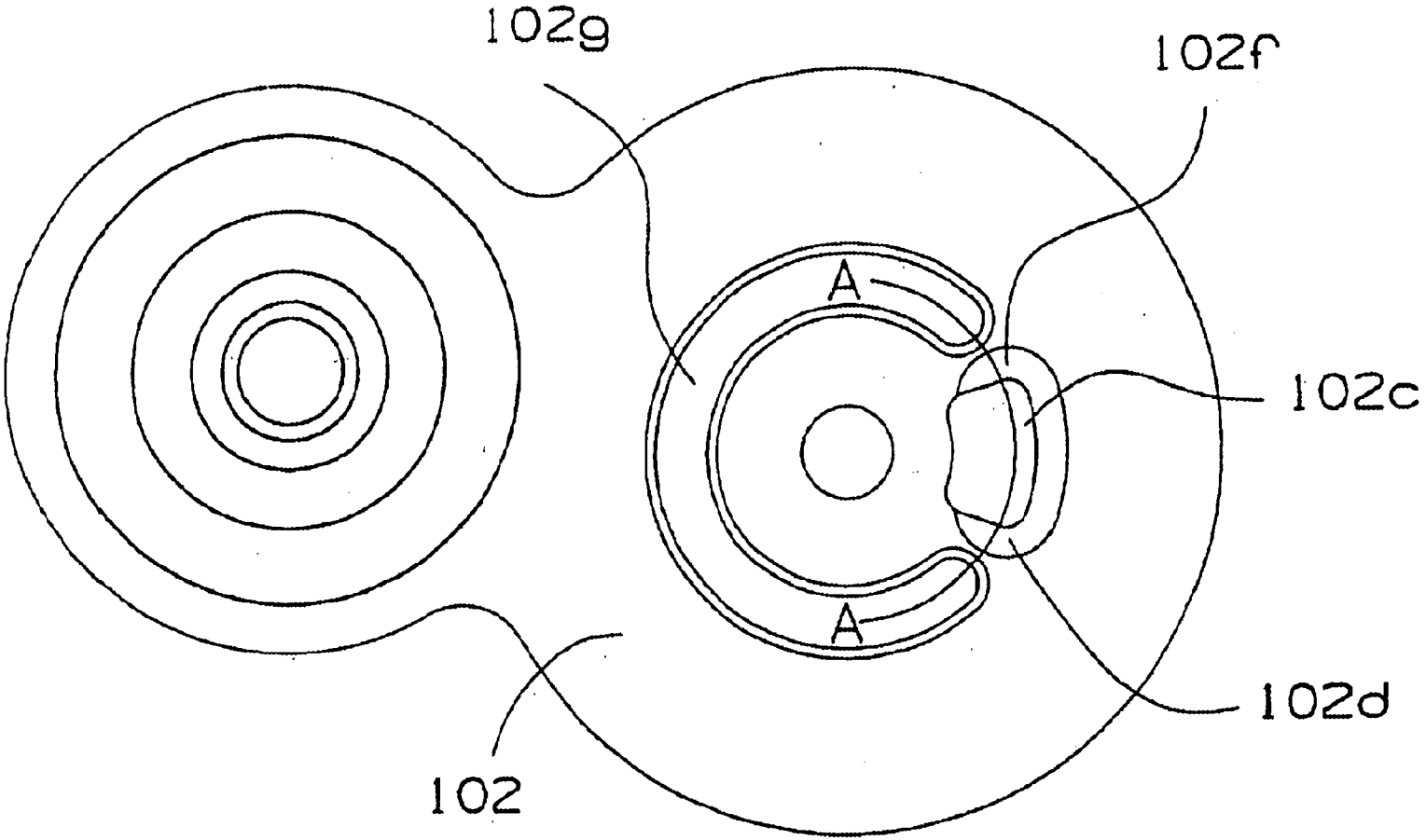
FIG. 13. is a magnified fragmentary plan view showing a part of the main plate positioned under the date indicator driving wheel and day star wheel in the embodiment of the timepiece with calendar mechanism of the invention.
Figure 14:
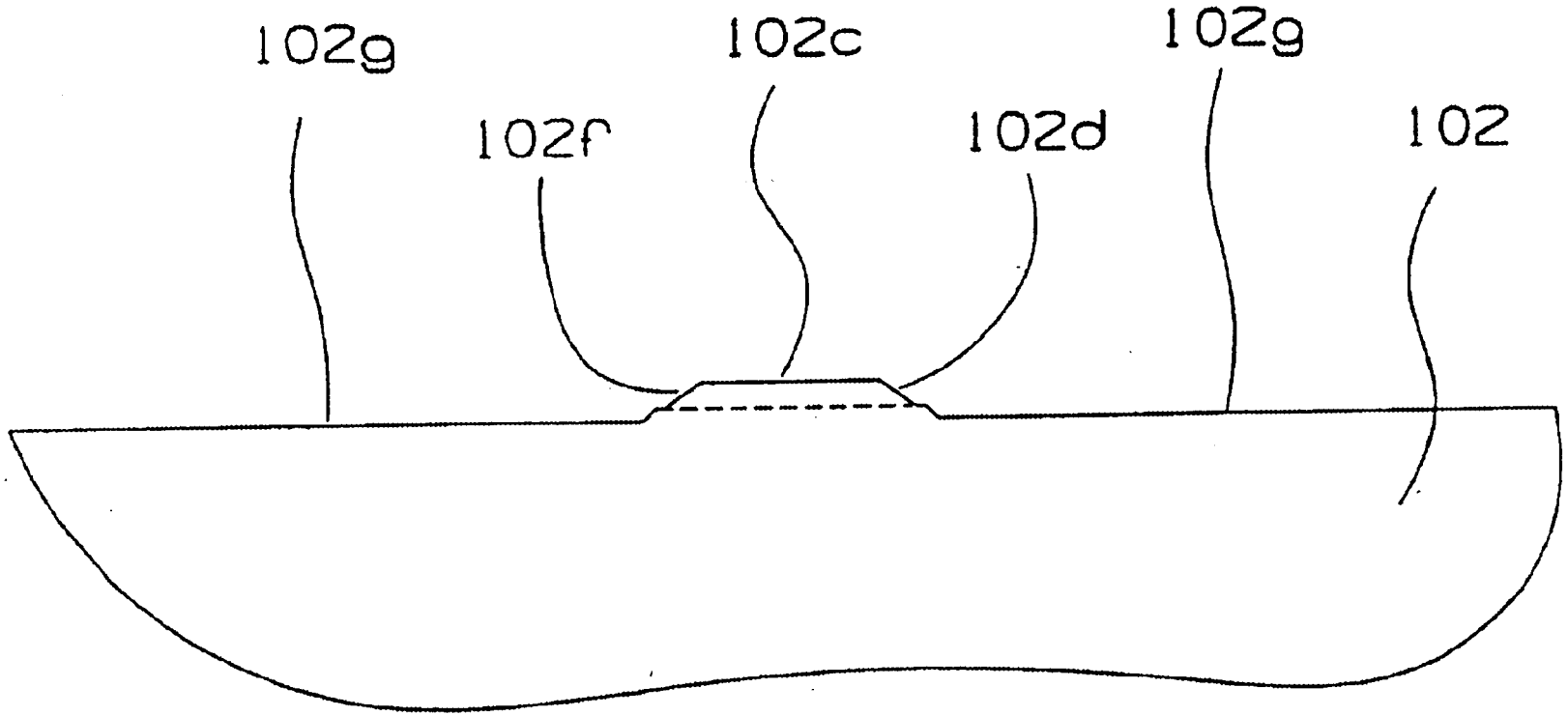
FIG. 14. is a magnified fragmentary plan view in the line A—A of FIG. 13 in the embodiment of the timepiece with calendar mechanism of the invention.

Referring to FIG. 13 and FIG. 14, a guide member or date feed finger guide portion 102*c* is provided on a back side (on a dial side) of the main plate 102 to secure an amount of meshing in a thickness direction of the main plate 102 between the date feed finger 214 and the feed operating tooth portion 222*b* when the date feed finger 214 meshes with the feed operating tooth portion 222*b*. Thus the date feed finger guide portion 102*c* constitutes displacing means for displacing the data feed finger 214 in the thickness direction of the main plate 102 to secure meshing engagement between the feed finger 214 and the feed operating tooth portion 222*b*. A slant surface 102*d* is provided in an area that a date feed finger convex portion 214*c* of the date feed finger 214 first contacts the date feed finger guide portion 102*c* due to rotation of the date indicator 212. A slant surface 102*f* is provided in an area that the date feed finger convex portion 214*c* leaves the date feed finger guide portion 102*c*. In an area where the date feed finger guide portion 102*c* is not present, a date feed finger escape groove 102*g* is provided on the back side (on the dial side) of the main plate 102. The date feed finger convex portion 214*c* is structured to rotate facing the date feed finger escape groove portion 102*g* without contacting the date feed finger escape groove portion 102*g*.

Where teeth count of the day star wheel 232 is fourteen, the day feed finger 216 is structured to feed the day star wheel 232 by two teeth per day. A first day feed portion 216*a* and a second day feed portion 216*b* are structured to respectively feed teeth portions of the day star wheel 232 by one tooth in one time.

The day feed finger 216 and the first day feed portion 216*a* have an intersection portion on the back side of which is provided a semispherical first day feed finger convex portion 216*c*. The day feed finger 216 and the second day feed portion 216*b* have an intersection portion on the back side of which (on the main plate side) is provided a semispherical second day feed finger convex portion 216*d*.

Although the teeth count in the teeth portion of the day star wheel 232 was explained as fourteen in the embodiment of the invention shown in FIG. 5 and FIG. 6, the teeth count of the day star wheel 232 may be seven or may be twenty-one. Where the teeth count of the day star wheel 232 is seven, the day feed finger 216 is structured to feed the day star wheel 232 by one tooth per day. Where the teeth count of the day star wheel 232 is twenty-one, the day feed finger 216 is structured to feed the day star wheel 232 by three teeth per day.

Meanwhile, the first day feed portion 216*a* and second day feed portion 216*b* provided on the tip of the day feed finger 216 were explained as the respective structures to feed the teeth portion of the day star wheel 232 by one tooth per time. However, the structure may be made such that the one day feed portion provided at the tip of the day feed finger 216 feeds the teeth portion of the day star wheel 232 by two teeth.

Referring to FIG. 5 and FIG. 6, in the embodiment of the timepiece with calendar mechanism of the invention, the date feed finger convex portion 214*c* of the date feed finger 214 in a date feed state first contacts a slant surface 102*d*. By providing the slant surface 102*d*, the date feed finger 214 smoothly operates to move over the date feed finger guide portion 102*c*. Next, the date feed finger convex portion 214*c* of the date feed finger 214 operates over the date feed finger guide portion 102*c* of the main plate 102. By operation of the date feed finger convex portion 214*c* over the date feed finger guide portion 102*c*, it is possible to secure meshing in a thickness direction between the date feed finger 214 and the date indicator tooth portion when the date feed finger 214 meshes with the feed operation tooth portion 222*b* of the date indicator 220.

The date feed finger convex portion 214*c* of the date feed finger 214 operates contacting the slant surface 102*f* thus leaving from the date feed guide portion 102*c*. By this structure, it is possible to positively feed the date indicator 220 while smoothly rotating the date feed finger 214.

Figure 7:
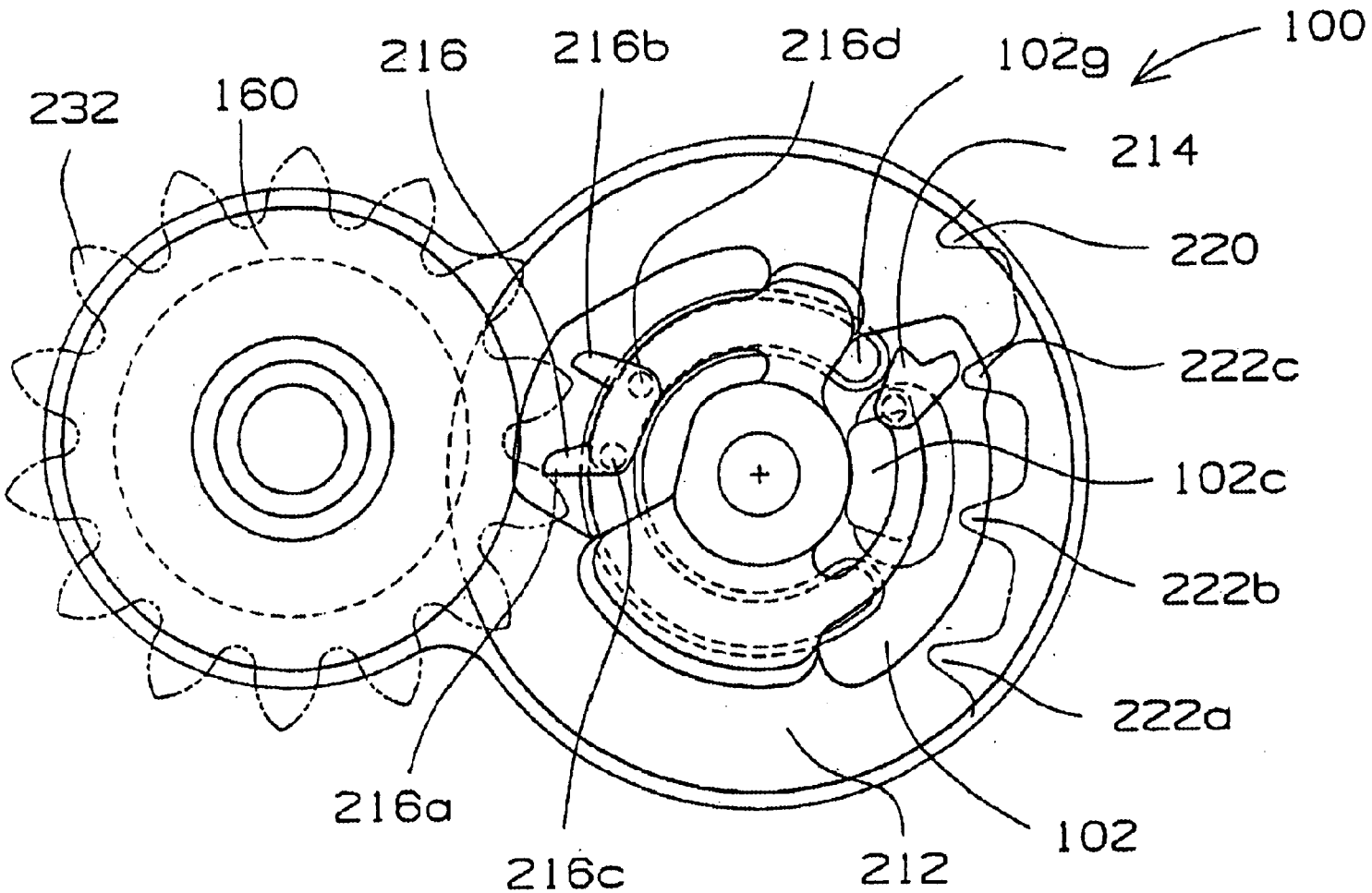
FIG. 7. is a magnified fragmentary plan view showing the date indicator, date indicator driving wheel and day star wheel in a day feed state in the embodiment of the timepiece with calendar mechanism of the invention.
Figure 8:
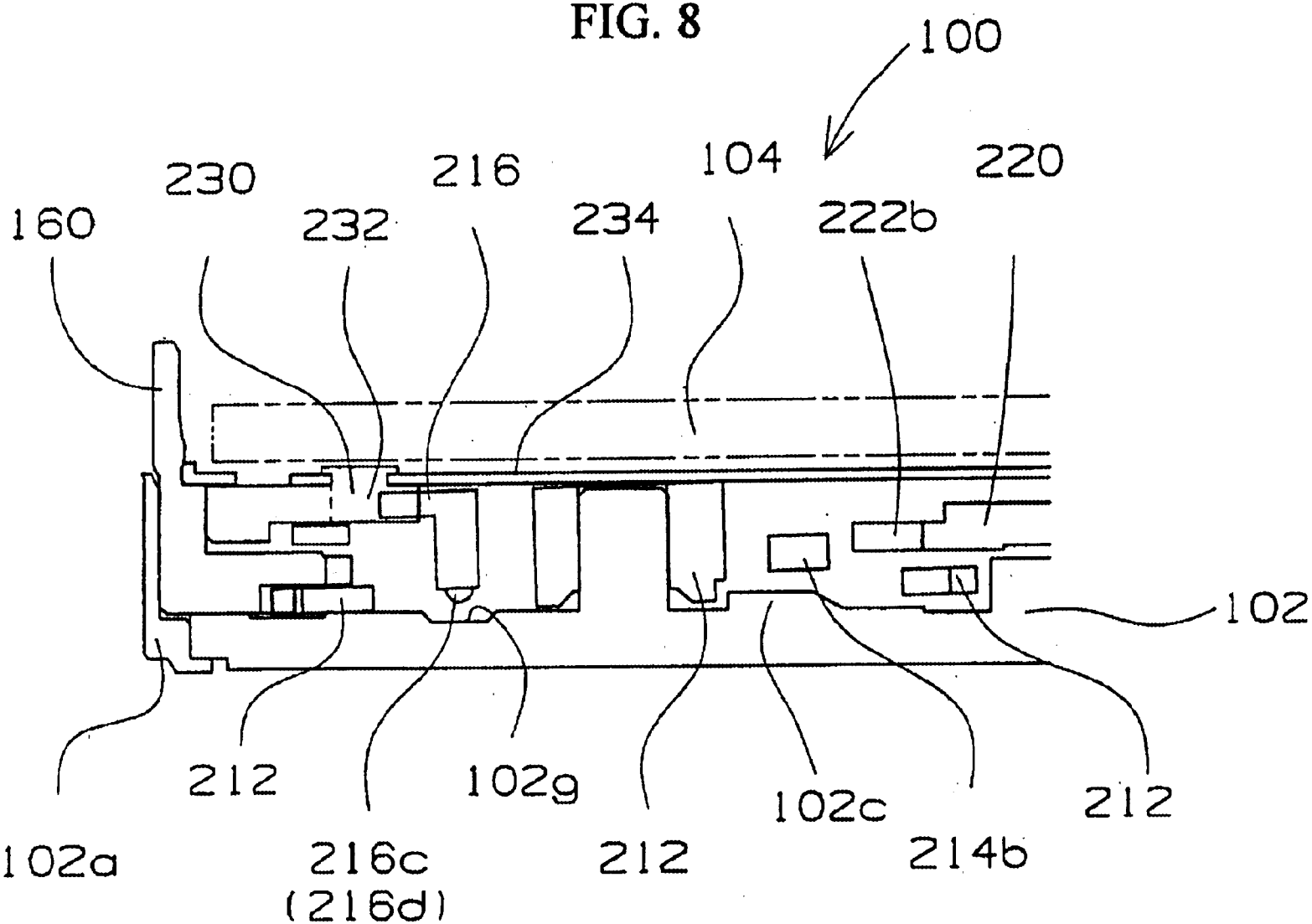
FIG. 8. is a magnified fragmentary sectional view showing the day feed state of FIG. 7 in the embodiment of the timepiece with calendar mechanism of the invention.

Referring to FIG. 7 and FIG. 8, in the embodiment of the timepiece with calendar mechanism of the invention, in a day feed state the first day feed portion 216*a* and the second feed portion 216*b* provided at the tip of the day feed finger 216 respectively feed one tooth of the teeth portion of the day star wheel 232 in one time. In the day feed state, the first day feed finger convex portion 216*c* and second day feed finger convex portion 216*d* face the date feed finger escape groove portion 102*g* and rotate without contact with the date feed finger escape groove portion 102*g*. Consequently, by this structure, the first day feed portion 216*a* operates without contacting the main plate 102 and also the second day feed portion 216*b* operates without contacting the main plate 102.

Figure 9:
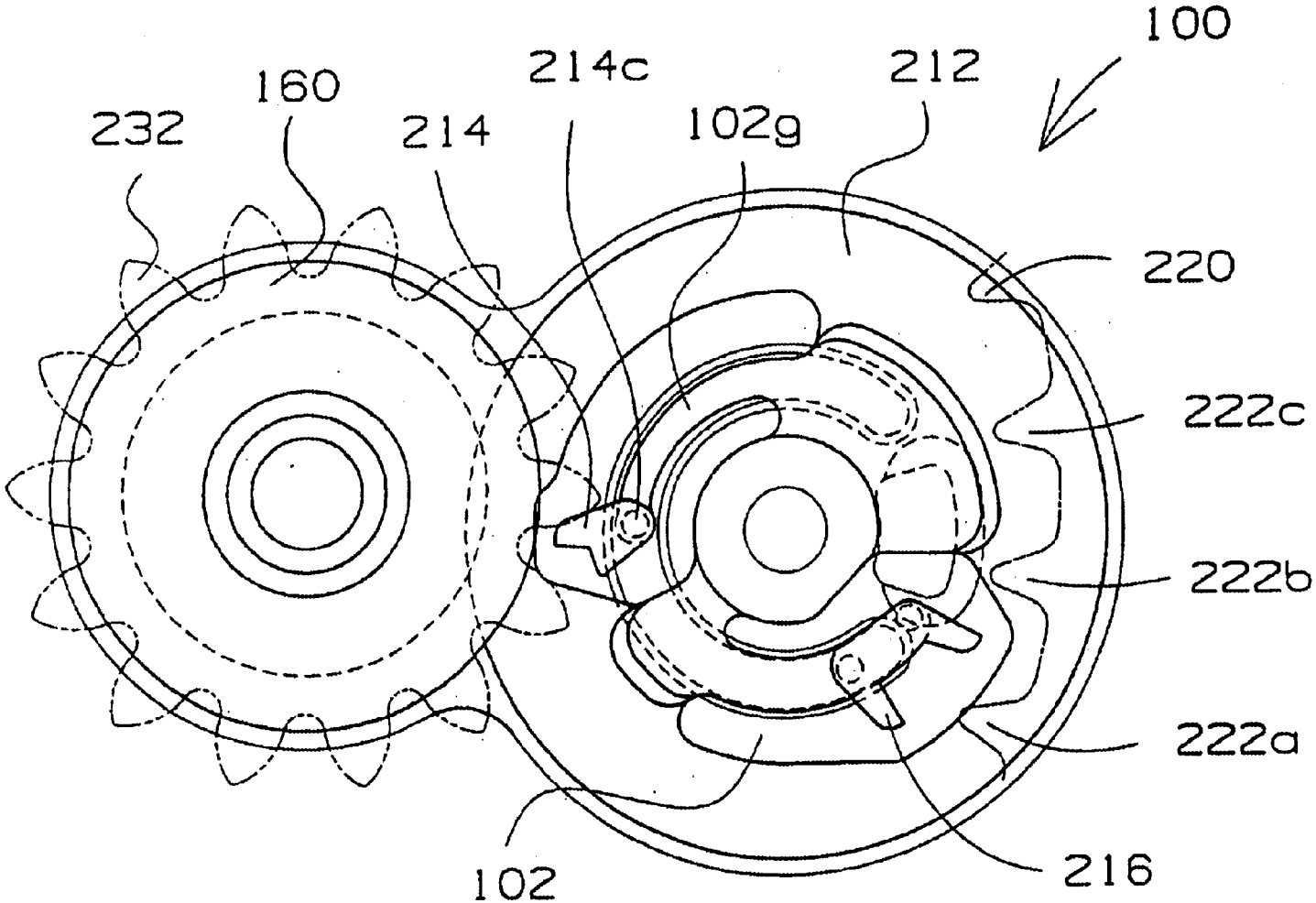
FIG. 9. is a magnified fragmentary plan view showing a state a date feed finger positions beneath the day star wheel in the embodiment of the timepiece with calendar mechanism of the invention.
Figure 10:
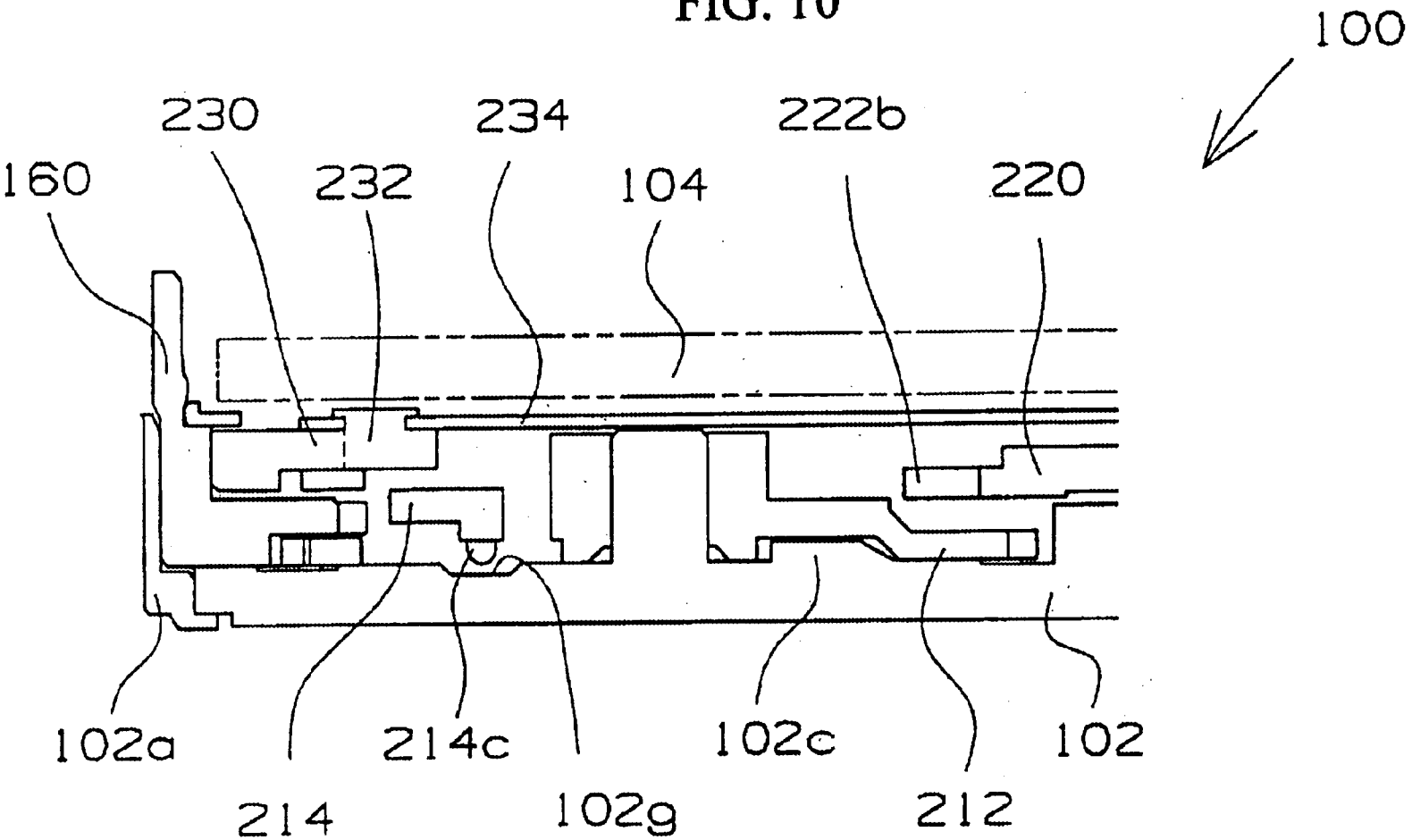
FIG. 10. is a magnified fragmentary sectional view showing the state of FIG. 9 in the embodiment of the timepiece with calendar mechanism of the invention.

Referring to FIG. 9 and FIG. 10, in the embodiment of the timepiece with calendar mechanism of the invention, in a state that the date feed finger 214 positions beneath the day star wheel 232, the date feed finger 214 rotates between the day star wheel 232 and the main plate 102. That is, the date feed finger 214 rotates passing through the main plate 102 side of the day star wheel 232 of a day indicator 230. In this state, the date feed finger convex portion 214*c* is facing the date feed finger escape groove portion 102*g* and rotates without contacting the date feed finger escape groove portion 102*g*. Consequently, due to this structure, the date feed finger convex portion 214*c* of the date feed finger 214 operates without contacting the main plate 102.

Figure 11:
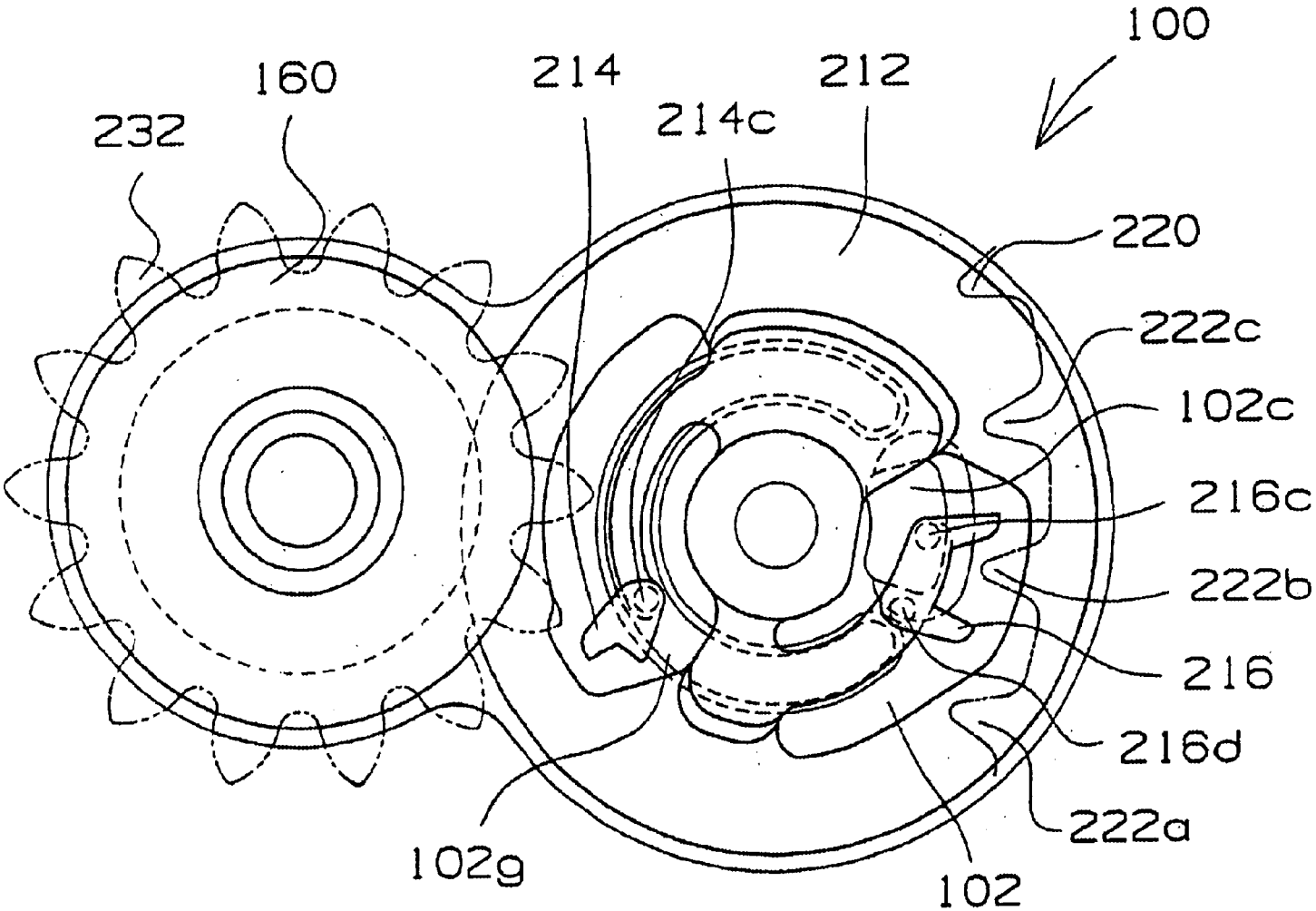
FIG. 11. is a magnified fragmentary plan view showing a state in which a day feed finger rides on a main plate base in the embodiment of the timepiece with calendar mechanism of the invention.
Figure 12:
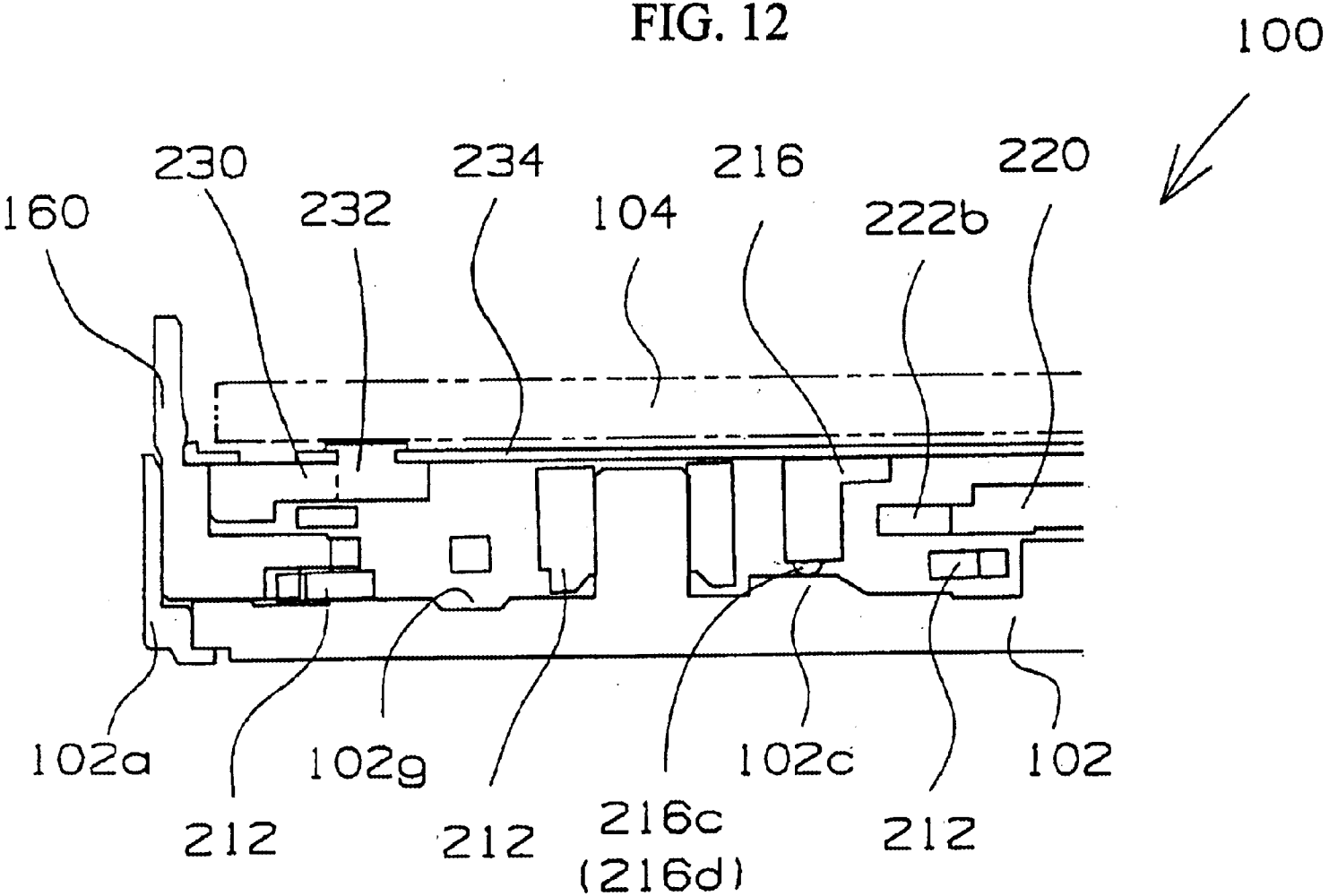
FIG. 12. is a magnified fragmentary sectional view showing the state of FIG. 11 in the embodiment of the timepiece with calendar mechanism of the invention.

Referring to FIG. 11 and FIG. 12, in a state that the day feed finger 216 is close to the feed operating tooth portion 222*b* of the date indicator 220, the first day feed finger convex portion 216*c* and second day feed finger convex portion 216*d* of the day feed finger 216 operate riding on the date feed finger guide portion 102*c* of the main plate 102. That is, the first day feed finger convex portion 216*c* and second day feed finger convex portion 216*d* firstly contact the slant surface 102*d*. Next, the first day feed finger convex portion 216*c* and second day feed finger convex portion 216*d* operate over the date feed finger guide portion 102*c* of the main plate 102. Then, the first day feed finger convex portion 216*c* and second day feed finger convex portion 216*d* operate contacting the slant surface 102*f*, leaving from the date feed finger guide portion 102*c*. That is, the tip of the first day feed portion 216*a* and the tip of the second day feed portion 216*b* rotate between the date indicator 220 and the day plate 314. Due to this structure, the day feed finger 216 can be avoided from contacting the date indicator 220 while smoothly rotating the day feed finger 216.

Next, explanation will be made on another embodiment of a timepiece with calendar mechanism of the invention.

Figure 15:
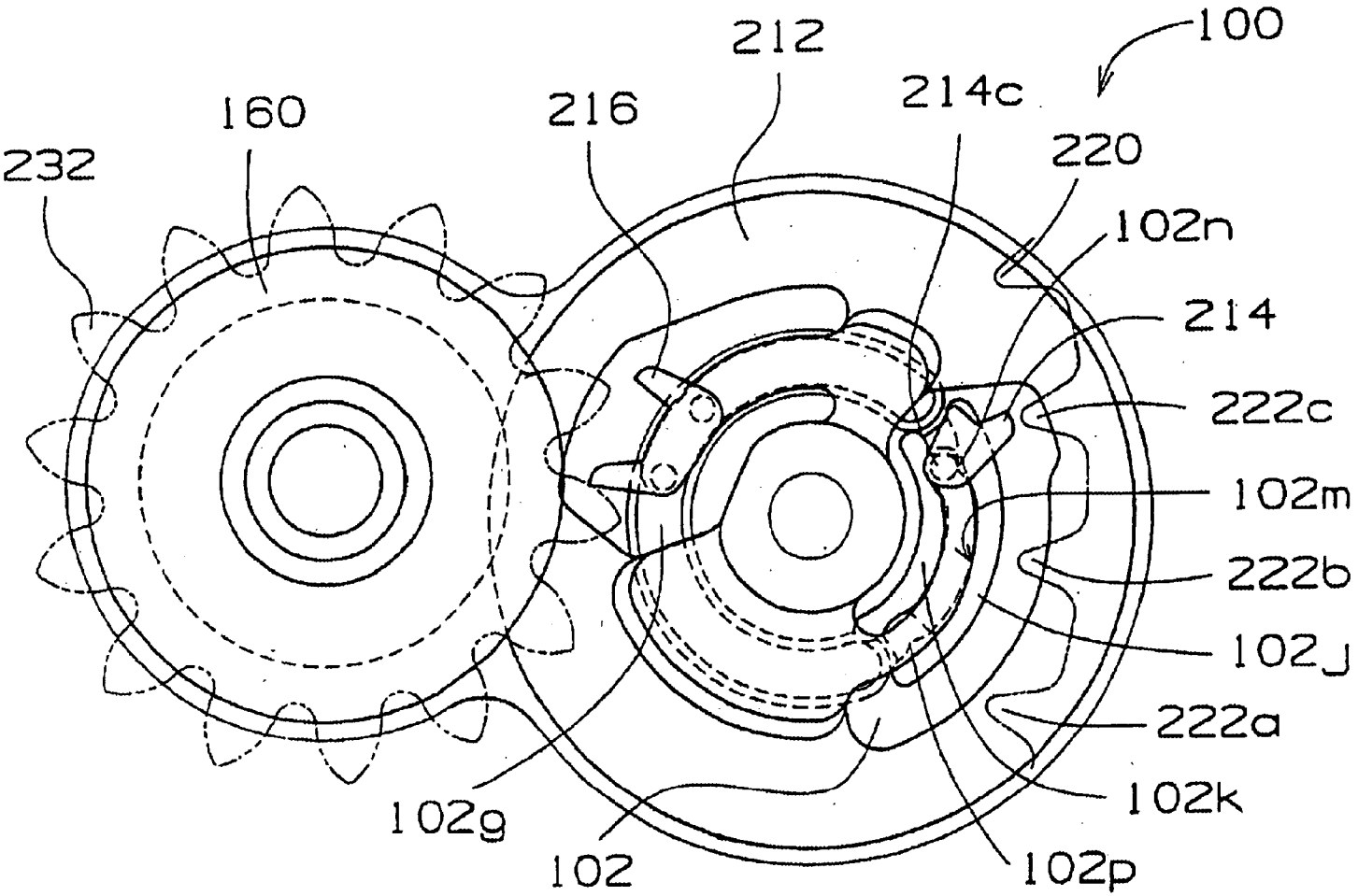
FIG. 15. is a magnified fragmentary plan view showing a state in which the date feed finger positions near a tooth tip of the date indicator having been fed in the embodiment of the timepiece with calendar mechanism of the invention.
Figure 16:
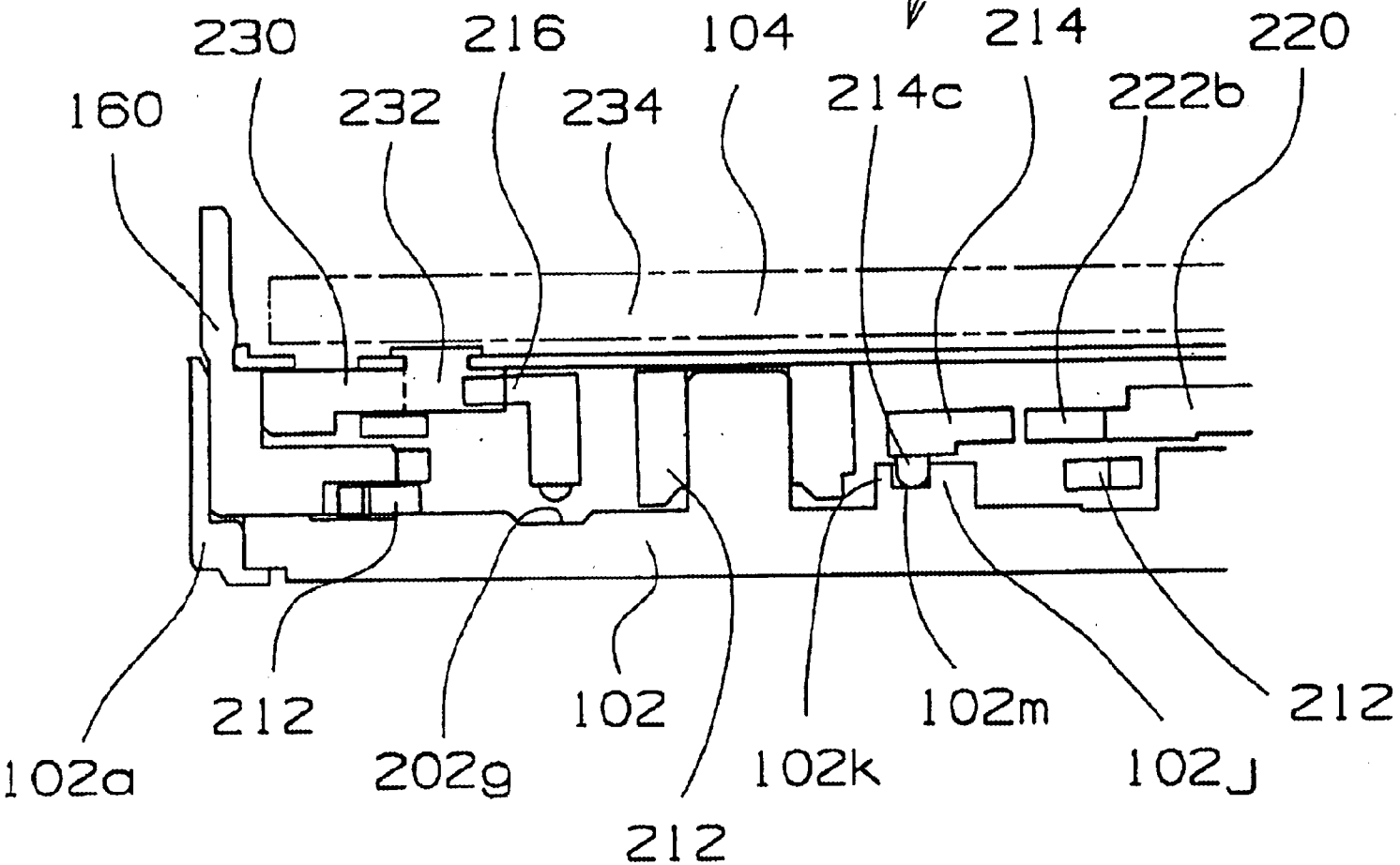
FIG. 16. is a magnified fragmentary sectional view showing the state of FIG. 15 in the embodiment of the timepiece with calendar mechanism of the invention.

Referring to FIG. 15 and FIG. 16, in another embodiment of a timepiece with calendar mechanism of the invention, a date feed finger guide groove portion 102*m* is provided on the back side (on the dial side) of the main plate 102 to secure a meshing amount in a thickness direction between the date feed finger 214 and the feed operating tooth portion 222*b* when the date feed finger 214 meshes with the feed operating tooth portion 222*b*.

An inner guide portion 102*k* is provided on the back side (on the dial side) of the main plate 102 to prevent against decrease in meshing amount between the date feed finger 214 and the feed operating tooth portion 222*b* when the date feed finger meshes with the feed operating tooth portion 222*b*. An outer guide portion 102*j* is provided on the back side (on the dial side) of the main plate 102 to prevent against increase in meshing amount between the date feed finger 214 and the feed operating tooth portion 222*b* when the date feed finger meshes with the feed operating tooth portion 222*b*. Consequently, the date feed finger guide groove portion 102*m* positions between the outer guide portion 102*j* and the inner guide portion 102*k*. The date feed finger convex portion 214*c* operates in the date feed finger guide groove portion 102*m* between the outer guide portion 102*j* and the inner guide portion 102*k*.

By providing the inner guide portion 102*k*, it is possible to effectively prevent the mesh amount between the date feed finger 214 and the feed operating tooth portion 222*b* from decreasing more than required. That is, the inner guide portion 102*k* can prevent the date feed finger 214 from disengages from the feed operating tooth portion 222*b* during date feeding.

Also, by providing the outer guide portion 102*j*, it is possible to effectively prevent the mesh amount between the date feed finger 214 and the feed operating tooth portion 222*b* from increasing more than required. That is, the outer guide portion 102*j* can prevent the date feed finger 214 from caving in the feed operating tooth portion 222*b* during date feeding.

Accordingly, by this structure, the date feed finger 214 can positively rotate the date indicator 220.

Furthermore, it is preferred to provide a slant surface in a location that the date indicator driving wheel 212 rotates and the date feed finger convex portion 214*c* first contacts the date feed finger guide groove portion 102*m*. Also, it is also preferred to provide a slant surface in a location that the date feed finger convex portion 214*c* leaves from the date feed finger guide groove portion 102*m*. Also, in a position that the date feed finger guide groove portion 102*m* is absent, the date feed finger escape groove portion 102*g* is provided on the back side (on the dial side) of the main plate 102. That is, the date feed finger convex portion 214*c* is structured to rotate in the date feed finger guide groove portion 102*m*.

In addition, a date feed forward gap secure portion 102*p* is provided on the back side (on the dial side) of the main plate 102 to secure a clearance in a planar direction between the date feed finger 214 and the feed-waiting teeth portion 222*a* when the date feed finger 214 rotates near the feed-waiting teeth portion 222*a*. The date feed forward gap secure portion 102*p* is formed in a convex shape from the outer guide portion 102*j* toward the inner side and in a form of providing the entire with smoothness in order to keep the date feed finger 214 away from the feed-waiting teeth portion 222*a*. By this structure, there is no fear that the date feed finger 214 contacts the feed-waiting tooth portion 222*a*.

In addition, a date feed rear gap secure portion 102*n* is provided on the back side (on the dial side) of the main plate 102 to secure a clearance in the planar direction between the date feed finger 214 and the feed-waiting teeth portion 222*c* when the date feed finger 214 rotates near the feed-end teeth portion 222*c*. The date feed rear gap secure portion 102*n* is formed in a convex shape from the outer guide portion 102*j* toward the inner side and in a form of providing the entire with smoothness in order to keep the date feed finger 214 away from the feed-end teeth portion 222*c*. By this structure, there is no fear that the date feed finger 214 contacts the feed-end tooth portion 222*c*.

In a date feed state, the date feed finger portion 214*c* of the date feed finger 214 first contacts the slant surface. Next, the date feed finger convex portion 214*c* of the date feed finger 214 rotates in the date feed finger guide groove portion 102*m* of the main plate 102. By the operation of the date feed finger convex portion 214*c* in the date feed finger guide groove portion 102*m*, when the date feed finger meshes with the feed operating teeth portion 222*b* of the date indicator 220, it is possible to secure a meshing amount in a thickness direction between the date feed finger 214 and the feed operating teeth portion 222*b*. At the same time, it is possible to keep within a constant range the meshing amount in the planar direction between the date feed finger 214 and the date indicator teeth portion.

Next, the date feed finger convex portion 214*c* of the date feed finger 214 rotates contacting the date feed finger clearance securing portion 102*n* of the main plate 102. Then, the date feed finger convex portion 214*c* of the date feed finger 214 operates contacting the slant surface, leaving from the date feed finger guide groove portion 102*m*.

Next, explanation will be made on still another embodiment of a timepiece with calendar mechanism of the invention.

Figure 17:
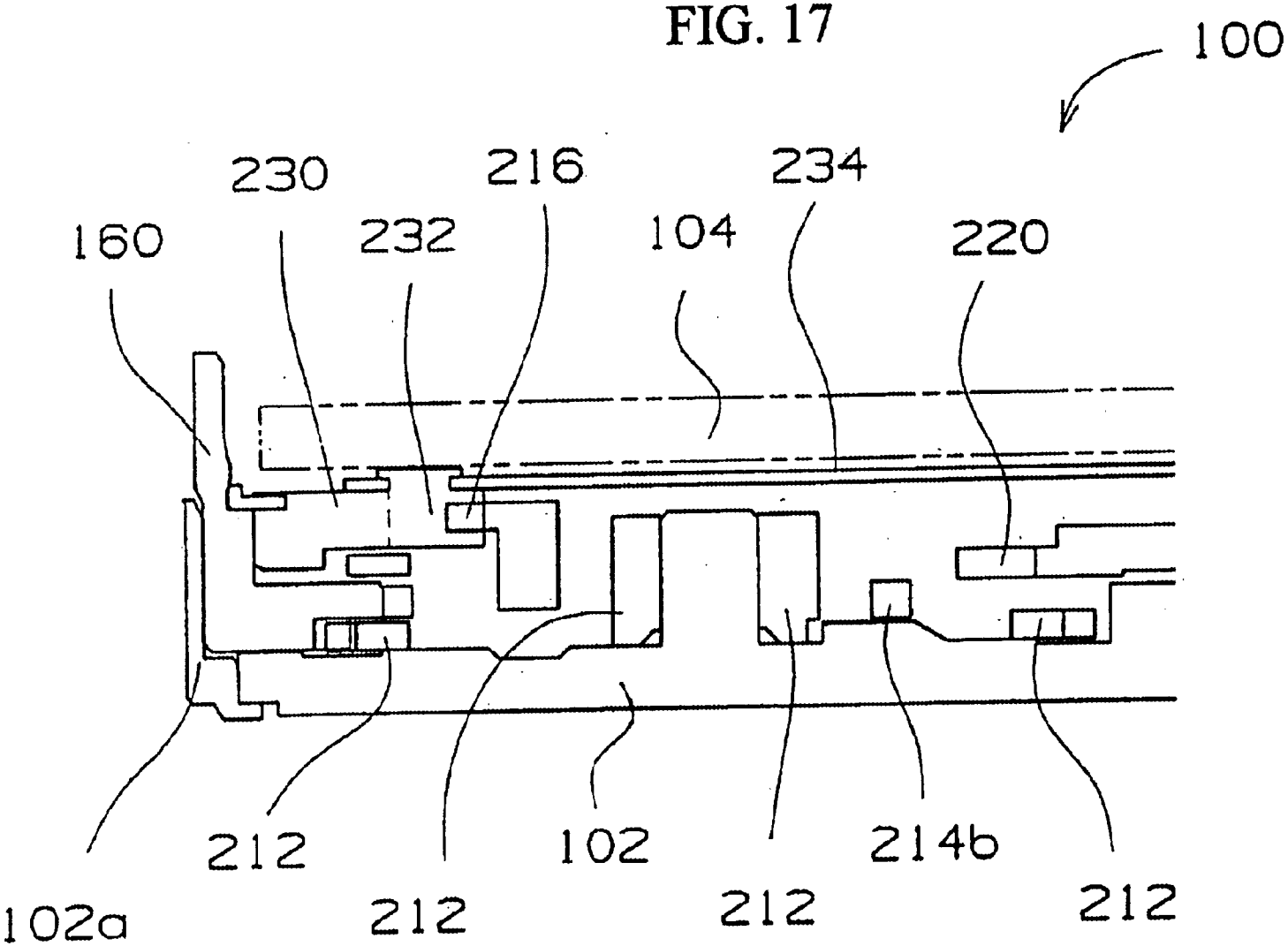
FIG. 17. is a fragmentary sectional view showing a case in which the day feed finger does not ride on the main plate base in the embodiment of the timepiece with calendar mechanism of the invention.
Figure 18:
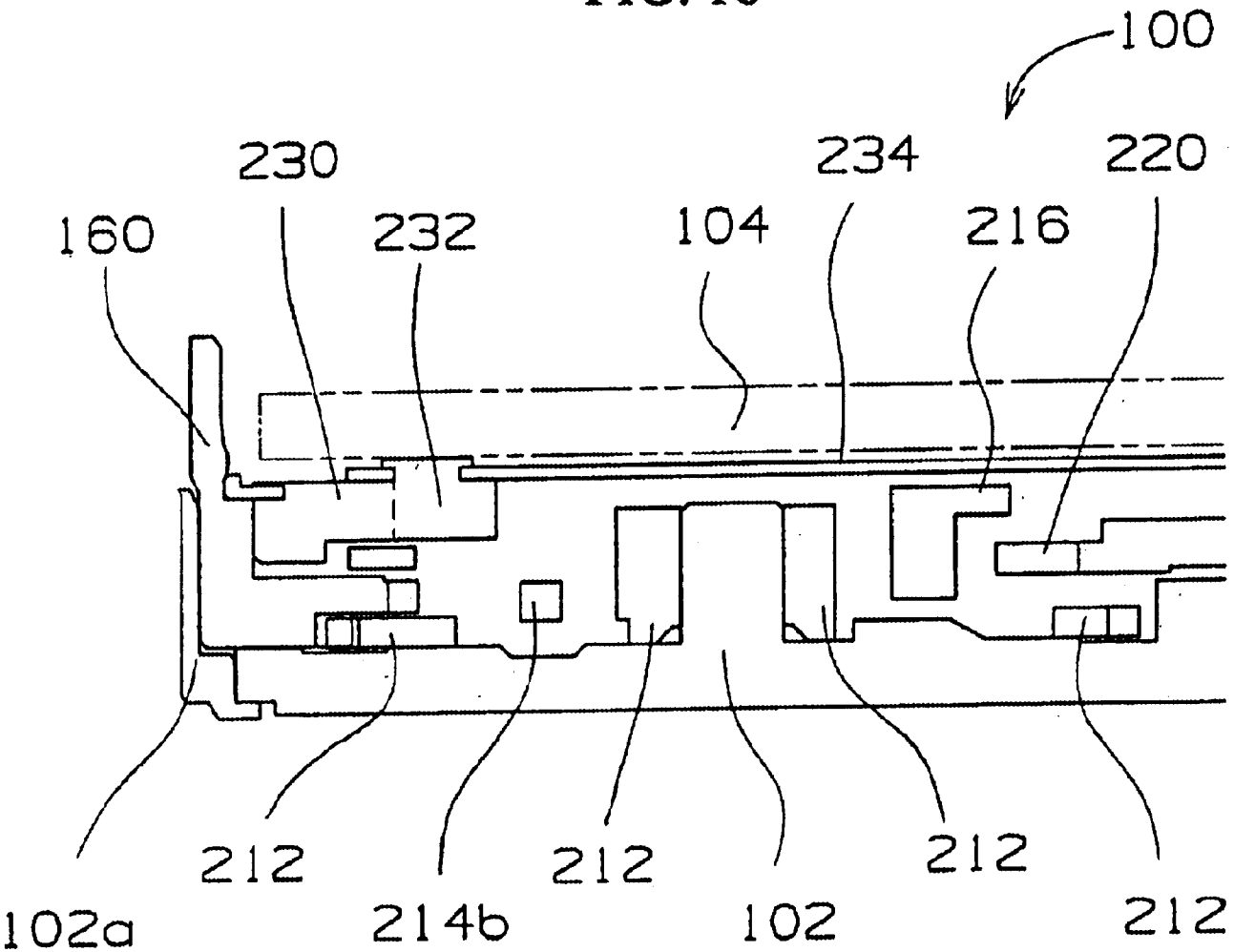
FIG. 18. is a fragmentary sectional view showing the case in which the day feed finger does not ride on the main plate base in the embodiment of the timepiece with calendar mechanism of the invention.
Figure 19:
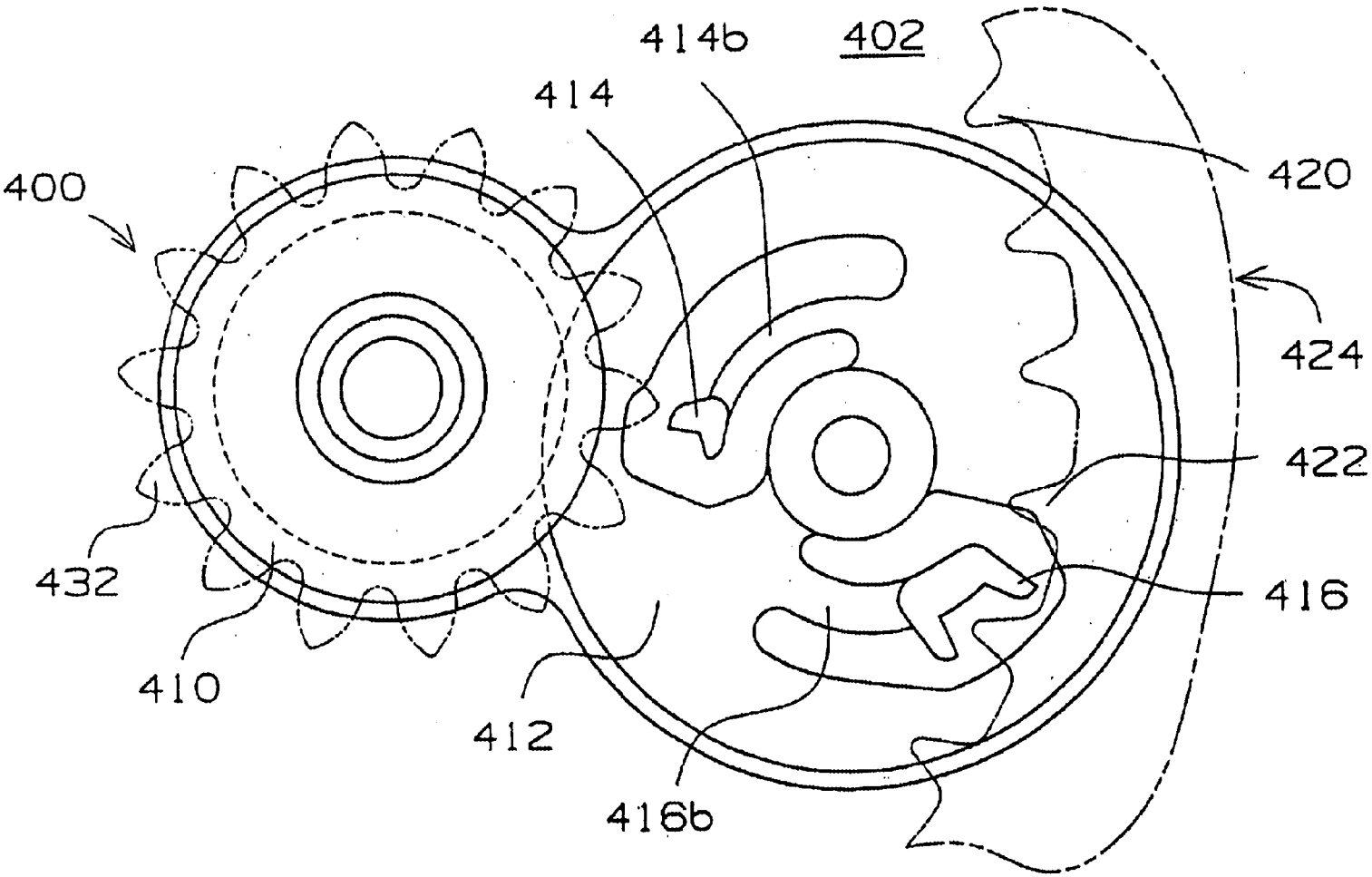
FIG. 19 PRIOR ART
FIG. 19. is a magnified fragmentary plan view showing a date indicator, date indicator driving wheel and day star wheel in the conventional timepiece with calendar mechanism.
Figure 20:
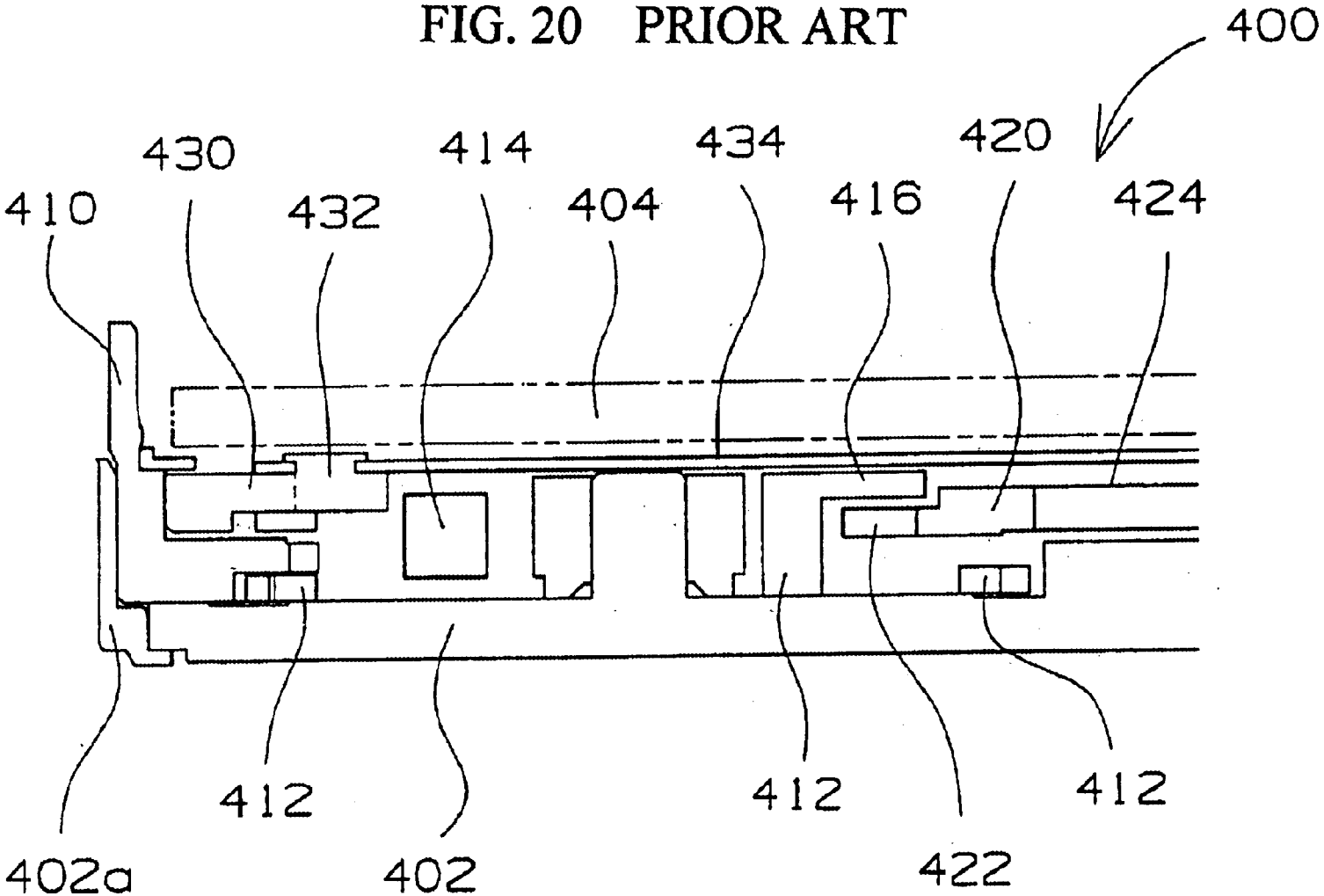
FIG. 20 PRIOR ART
FIG. 20. is a magnified fragmentary sectional view of the part shown in FIG. 19 in the conventional timepiece with calendar mechanism.

Referring to FIG. 17 and FIG. 18, in still another embodiment of a timepiece with calendar mechanism of the invention, the semispherical first day feed finger convex portion 216*c* is absent in the backside (on the main plate side) of the intersection between the day feed finger 216 and the first day feed portion 216*a*.

In this embodiment, by providing great a gap between the date indicator teeth portion 222 of the date indicator 220 and the day plate 234, the tip of the first day feed portion 216*a* and the tip of the second day feed portion 216*b* are structured to rotate between the date indicator 220 and the day plate 234.

Although the embodiments explained above explained the timepiece with a second hand, the structure of the invention is applicable to a timepiece without having a second hand.

The present invention, by being structured as explained above, can realize a timepiece with calendar mechanism free from fear of erroneous operation in the day indicator and has a date feed finger capable of positively rotating the date indicator.

Furthermore, the present invention can realize a timepiece with calendar mechanism small in size and thickness.

What is claimed is:

1. A calendar timepiece comprising:

a main plate having a guide portion;

a date indicator driving wheel mounted on the main plate to undergo rotation;

a date feed finger connected to the date indicator driving wheel for rotation therewith to engage the guide portion of the main plate so that the date feed finger is displaced in a generally thickness direction of the main plate;

a date indicator having a tooth portion for meshing engagement with the date feed finger when the date feed finger engages the guide portion of the main plate and is displaced in the thickness direction of the main plate so that the date indicator undergoes rotation relative to the main plate to indicate date information during rotation of the date feed finger;

a day feed finger connected to the date indicator driving wheel for rotation therewith; and a day indicator connected to the day feed finger for rotation therewith to indicate a day of the week.

2. A calendar timepiece according to claim 1; wherein the main plate has an inclined surface portion extending from the guide portion so that the date feed finger engages the inclined surface portion prior to engagement with the guide portion.

3. A calendar timepiece according to claim 1; wherein the date feed finger has a semispherical convex portion for contacting the guide portion of the main plate.

4. A calendar timepiece according to claim 1; wherein the day feed finger contacts the guide portion of the main plate during rotation of the day feed finger in order to provide a gap in a thickness direction of the main plate between the day feed finger and the tooth portion of the date indicator.

5. A calendar timepiece according to claim 1; wherein the date feed finger has a spring portion connected to the date indicator driving wheel.

6. A calendar timepiece according to claim 5; wherein the day feed finger has a spring portion connected to the date indicator driving wheel.

7. A calendar timepiece according to claim 1; wherein the day feed finger has a spring portion connected to the date indicator driving wheel.

8. A calendar timepiece according to claim 1; wherein the day indicator has a day star wheel rotationally driven by the day feed finger; and wherein the date feed finger does not contact the day star wheel during rotation of the date feed finger.

9. A calendar timepiece according to claim 1; wherein the main plate has a groove portion formed in a part of the main plate where the guide portion is not provided; and wherein the date feed finger has a convex portion which confronts but does not contact the groove portion of the main plate during rotation of the date feed finger.

10. A calendar timepiece comprising:

a main plate having a groove portion;

a date indicator driving wheel mounted on the main plate to undergo rotation;

a date feed finger connected to the date indicator driving wheel for rotation therewith;

a date indicator having a tooth portion for meshing engagement with the date feed finger for undergoing rotation relative to the main plate to indicate date information during rotation of the date feed finger, the date feed finger engaging the groove portion of the main plate during rotation thereof in order to secure meshing engagement between the date feed finger and the tooth portion of the date indicator in a thickness direction of the main plate;

a day feed finger connected to the date indicator driving wheel for rotation therewith; and a day indicator connected to the day feed finger for rotation therewith to indicate a day of the week.

11. A calendar timepiece according to claim 10; wherein the date indicator has a toothed member having a first tooth portion as the tooth portion for meshing engagement with the date feed finger and a second tooth portion disposed forwardly of the first tooth portion with respect to a direction of rotation of the date feed finger; and wherein the main plate has a portion for providing a gap between the date feed finger and the second tooth portion when the date feed finger rotates near the second tooth portion.

12. A calendar timepiece according to claim 11; wherein the date indicator has a third tooth portion disposed rearwardly of the first tooth portion with respect to the direction of rotation of the date feed finger; and wherein the main plate has a portion for providing a gap between the date feed finger and the third tooth portion when the date feed finger rotates near the third tooth portion.

13. A calendar timepiece according to claim 10; wherein the date indicator has a toothed member having a first tooth portion as the tooth portion for meshing engagement with the date feed finger and a rearward tooth portion disposed rearwardly of the first tooth portion with respect to a direction of rotation of the date feed finger; and wherein the main plate has a portion for providing a gap between the date feed finger and the rearward tooth portion when the date feed finger rotates near the rearward tooth portion.

14. A calendar timepiece according to claim 10; wherein the main plate has an inner guide portion for preventing a decrease in meshing engagement between the date feed finger and the tooth portion of the date indicator, and an outer guide portion for preventing an increase in meshing engagement between the date feed finger and the tooth portion of the date indicator, the groove portion being disposed between the inner and outer guide portions.

15. A calendar time piece according to claim 14; wherein the groove portion of the main plate is disposed between the inner and outer guide portions of the main plate.

16. A calendar timepiece according to claim 10; wherein the date feed finger has a semispherical convex portion for engaging the groove portion of the main plate.

17. A calendar analog electronic timepiece comprising: a main plate having a guide portion; a date indicator driving wheel mounted on the main plate to undergo rotation; a date feed finger connected to the date indicator driving wheel for rotation therewith to engage the guide portion of the main plate so that the date feed finger is displaced in a generally thickness direction of the main plate; a date indicator having a tooth portion for meshing engagement with the date feed finger when the date feed finger engages the guide portion of the main plate and is displaced in the thickness direction of the main plate so that the date indicator undergoes rotation relative to the main plate to indicate date information during rotation of the date feed finger; a quartz oscillator for producing an oscillating output for use as a time base of the calendar analog electronic timepiece, the quartz oscillator having a portion disposed in overlapping relation with the date indicator; and a step motor having a rotor, a stator spaced from the rotor, and a coil block for magnetizing the stator to rotate the rotor, the coil block having a portion disposed in overlapping relation with the date indicator.

18. A calendar analog electronic timepiece according to claim 17; further comprising a day feed finger connected to the date indicator driving wheel for rotation therewith; and a day indicator connected to the day feed finger for rotation therewith to indicate a day of the week.

19. A calendar analog electronic timepiece according to claim 18; further comprising a front wheel train supported by the main plate for undergoing rotation in accordance with rotation of the rotor of the step motor.

20. A calendar analog electronic timepiece according to claim 17; further comprising a front wheel train supported by the main plate for undergoing rotation in accordance with rotation of the rotor of the step motor.

21. A calendar timepiece comprising:

a main plate;

a date indicator driving wheel mounted on the main plate to undergo rotation;

a date feed finger connected to the date indicator driving wheel for rotation therewith;

a date indicator having a tooth portion for meshing engagement with the date feed finger so that the date indicator undergoes rotation relative to the main plate to indicate date information during rotation of the date feed finger; and displacing means for displacing the date feed finger to a preselected position in a thickness direction of the main plate to secure meshing engagement between the date feed finger and the tooth portion of the date indicator.

22. A calendar timepiece according to claim 21; wherein the displacing means comprises a guide portion of the main plate engageable with the date feed finger to guide the date feed finger to the preselected position.

23. A calendar time piece according to claim 22; wherein the main plate has a surface portion extending from the guide portion and disposed at an inclination relative to the thickness direction of the main plate.

24. A calendar timepiece according to claim 23; wherein the inclined surface portion extends from the guide portion so that the date feed finger engages the inclined surface portion prior to engagement with the guide portion.

25. A calendar timepiece according to claim 22; wherein the date feed finger has a semispherical convex portion for engaging the guide portion of the main plate.

26. A calendar timepiece according to claim 21; further comprising a day feed finger connected to the date indicator driving wheel for rotation therewith; and a day indicator connected to the day feed finger for rotation therewith to indicate a day of the week.

27. A calendar timepiece according to claim 26; wherein the day indicator has a day star wheel rotationally driven by the day feed finger; and wherein the date feed finger does not contact the day star wheel during rotation of the date feed finger.

* * * * *